US011148193B2

(12) United States Patent
Nooning, Jr. et al.

(10) Patent No.: US 11,148,193 B2
(45) **Date of Patent: *Oct. 19, 2021**

(54) METHOD FOR CASTING METAL STRIP WITH EDGE CONTROL

(71) Applicant: NUCOR CORPORATION, Charlotte, NC (US)

(72) Inventors: Robert Nooning, Jr., Zionsville, IN (US); Harold Bradley Rees, Ladoga, IN (US); Jeffery Edward Keffer, Blytheville, AR (US)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/909,287

(22) Filed: Jun. 23, 2020

(65) Prior Publication Data

US 2020/0384528 A1 Dec. 10, 2020

Related U.S. Application Data

(63) Continuation of application No. 16/009,568, filed on Jun. 15, 2018, now Pat. No. 10,722,940.

(60) Provisional application No. 62/520,243, filed on Jun. 15, 2017.

(51) Int. Cl.

| | |
|---|---|
| ***B22D 11/16*** | (2006.01) |
| ***B22D 11/06*** | (2006.01) |
| ***B22D 11/14*** | (2006.01) |
| ***B22D 11/18*** | (2006.01) |

(52) U.S. Cl.

CPC ..... *B22D 11/16* (2013.01); *B22D 11/0622* (2013.01); *B22D 11/0651* (2013.01); *B22D 11/141* (2013.01); *B22D 11/168* (2013.01); *B22D 11/188* (2013.01)

(58) Field of Classification Search

CPC . B22D 11/06; B22D 11/0622; B22D 11/0651; B22D 11/14; B22D 11/141; B22D 11/16; B22D 11/168; B22D 11/18; B22D 11/188

USPC ... 164/151.2, 151.4, 154.5, 154.7, 428, 480, 164/452, 455

See application file for complete search history.

(56) References Cited

U.S. PATENT DOCUMENTS 10,722,940 B2 * 7/2020 Nooning, Jr. et al. ..... B22D 11/188

* cited by examiner

*Primary Examiner* — Kevin P Kerns

(74) *Attorney, Agent, or Firm* — Hahn Loeser & Parks, LLP

(57) ABSTRACT

Systems and apparatus for continuously casting thin strip where one or more expansion rings are positioned within at least one of a pair of casting rolls, and automatically measuring a thickness of the cast strip close to the first side edge of the strip using at least one sensor. If the thickness measured is too thin, automatically decreasing the radial dimension of the expansion ring arranged in close proximity to the first side edge to cause the cylindrical tube to contract and increase the thickness of the cast strip during casting. If the thickness measured indicates that the thickness of the cast strip is too thick, automatically increasing the radial dimension of the expansion ring arranged in close proximity to the first side edge to cause the cylindrical tube to expand and reduce the thickness of the cast strip during casting.

20 Claims, 17 Drawing Sheets

METHOD FOR CASTING METAL STRIP WITH EDGE CONTROL

CROSS-REFERENCE TO RELATED APPLICATIONS

This application is a continuation of and claims priority to and the benefit of U.S. Ser. No. 16/009,568, filed Jun. 15, 2018, now U.S. Pat. No. 10,722,940, and further claims priority to, and the benefit of, U.S. Provisional Application No. 62/520,243, filed Jun. 15, 2017 with the U.S. Patent Office, which is hereby incorporated by reference.

BACKGROUND

This invention relates to the casting of metal strip by continuous casting in a twin roll caster.

In a twin roll caster, molten metal is introduced between a pair of counter-rotated horizontal casting rolls that are cooled so that metal shells solidify on the moving casting roll surfaces and are brought together at a nip between them to produce a solidified strip product delivered downwardly from the nip between the casting tolls. The term "nip" is used herein to refer to the general region at which the casting tolls are closest together. The molten metal may be poured from a ladle into a smaller vessel or series of smaller vessels from which it flows through a metal delivery nozzle and nozzles located above the nip forming a casting pool of molten metal supported on the casting surfaces of the casting rolls immediately above the nip and extending along the length of the nip. This casting pool is usually confined between side plates or dams held in sliding engagement with end surfaces of the casting rolls so as to restrict the two ends of the casting pool against outflow.

The twin roll caster is capable of continuously producing cast strip from molten steel through a sequence of ladles positioned on a turret. The molten metal is poured from each ladle in turn into a tundish and then into a moveable tundish before flowing through the metal delivery nozzle into the casting pool. The tundish enables the exchange of an empty ladle for a full ladle on the turret without disrupting the production of the cast strip.

In casting thin metal strips, it is often important to control the edge thickness of the thin metal strip during the casting process. For example, it is not uncommon in certain instances for the portion of the thickness of the strip in close proximity to a side edge of the thin strip to be too thin or wavy. It is additionally important to control the thickness profile to ensure that the strip is not too thick or thin. Therefore, there is a need to better control the thickness of the thin strip at and/or in close proximity to the strip side edges and even more generally across the strip width. There is also a need to provide automated control, as manual control may result in delayed responses to undesired changes in strip thickness, which in turn impacts product quality.

SUMMARY

Disclosed is a method of continuous casting thin strip by automatically measuring the strip thickness during casting, and thereafter automatically determining whether portions of the strip thickness in close proximity to the side edges of the strip deviate from a target thickness or thickness profile, and if sufficiently deviating, automatically controlling the annular size of any expansion ring arranged within any one or both casting roll cylinders to achieve a desired thickness or thickness profile.

In one example, a casting roll control system with adjustable circumference control for use in a twin mil caster for producing cast strip metal includes a casting roll including a casting surface formed by a cylindrical tube, a logic controller, at least a first expansion ring disposed within the cylindrical tube near an edge of the casting surface, and a plurality of strip thickness sensors. The expansion ring has at least one heating element and at least one temperature sensor adapted to provide signals indicative of expansion ring temperature. The temperature sensor is coupled to the logic controller. The expansion ring is formed of a material that expands an outer diameter of the expansion ring when heated by the at least one heating element, thereby expanding an outer diameter of the casting surface corresponding to a location of the expansion ring. The plurality of strip thickness sensors are adapted to provide output signals indicative of a thickness of a cast strip, the strip thickness sensors being located to measure thicknesses across a width of a cast strip including an edge thickness. The plurality of strip thickness sensors are coupled to the logic controller. The logic controller is configured with instructions stored in non-volatile memory to receive thickness measurements from the strip thickness sensors and temperature measurements from the at least one temperature sensor, fit a curve to the thickness measurements, determine a target edge thickness of the cast strip based on the curse, determine a delta thickness as a difference between the measured edge thickness and the target edge thickness and cause an amount of power applied to the heating elements to be adjusted to reduce the delta thickness. A second expansion ring may be disposed within the cylindrical tube at an edge of the casting surface opposite the first expansion ring surface opposite the first expansion ring and controlled in the likewise manner.

The curve fitted to the thickness measurements may be a polynomial function defining a parabola. The target edge thickness may be determined as an extrapolation of the curve fitted to the thickness measurements. The target edge thickness may also be determined as an extrapolation of the curve fitted to the thickness measurements with a positive or negative offset added.

The cylindrical tube may have a thickness of no more than 80 millimeters. The casting roll control system may further include a power controller coupled between the logic controller and the heating element, wherein the power controller increases and decreases an amount of power being applied to the heating element in response to a signal from the logic controller.

The logic controller may configured to periodically update the curve fitted to the thickness measurements based on new measurements, and periodically update the target edge thickness based on the updated curve. In another example, the logic controller may be configured to continuously update the curve fitted to the thickness measurements based on new measurements, and continuously update the target edge thickness based on the updated curve.

The expansion rings may further have water passages there through, and the logic controller may be further configured with instructions stored in non-volatile memory to cause an amount of water flowing through the expansion rings to be adjusted to reduce the delta thickness.

The logic controller may be configured with instructions stored in non-volatile memory to cause an amount of power applied to the at least one heating element to be adjusted by determining a target temperature of the expansion ring based on the delta thickness, measuring the temperature of the expansion ring, determining a delta temperature as a difference between the measured temperature with the target temperature, and causing an amount of power applied to the at least one healing element to be adjusted to reduce the delta temperature.

A method for controlling a casting roll with at least one expansion ring having at least one heating element disposed within the casting roll to provide adjustable circumference control, the casting roll being for use in a twin roll caster for producing cast strip metal, is also provided. The method includes: making a plurality of thicknesses measurements across a width of a cast strip including an edge thickness; fitting a curve to the thickness measurements; determining a target edge thickness of the cast strip based on the curve; determining a delta thickness as a difference between the measured edge thickness and the target edge thickness; and causing an amount of power applied to the at least one heating element to be adjusted to reduce the delta thickness.

The step of causing an amount of power applied to die at least one heating element to be adjusted may further comprise: determining a target temperature of the expansion ring based on the delta thickness; measuring the temperature of the expansion ring; determining a delta temperature as a difference between the measured temperature with the target temperature; and causing an amount of power applied to the at least one heating element to be adjusted to reduce the delta temperature.

The curve fitted to the thickness measurements may be a polynomial function defining a parabola. The target edge thickness may be determined as an extrapolation of the curve fitted to the thickness measurements. The target edge thickness may also be determined as an extrapolation of the curve fitted to the thickness measurements with a positive or negative Offset added.

The steps of making a plurality of thickness measurements, fitting a curve to the thickness measurements, and determining a target edge thickness may be repeated periodically. The steps of making a plurality of thickness measurements, fitting a curve to the thickness measurements, and determining a target edge thickness may also be repeated continuously.

Additional embodiments provide a method of continuously casting thin strip comprising:

providing a strip caster having a pair of counter rotating casting rolls with a nip there between capable of delivering cast strip downwardly from the nip, each casting roll having a casting surface formed by a cylindrical tube having a thickness (that is, a wall thickness) of no more than 80 millimeters and formed of a material selected from the group consisting of copper and copper alloy, and optionally having a metal or metal alloy coating thereon, each casting roll also having a plurality of longitudinal water flow passages extending through the cylindrical tube, where at least two expansion rings are arranged within at least one cylindrical tube of the pair of casting rolls, where said expansion rings are substantially coaxial with the corresponding cylindrical tube and are each positioned in close proximity to ore of a pair of locations along the corresponding casting roll where one of opposing of first and second side edges of the cast strip are to be arranged when formed on opposite end portions of the casting rolls during a casting campaign, each expansion ring adapted to increase and decrease in radial dimension causing the cylindrical tube to expand and contract, respectively, to thereby change the thickness of the cast strip during casting;

providing a metal delivery system capable of forming a casting pool supported on the casting surfaces of the casting rolls above the nip with side dams adjacent to the ends of the nip to confine the casting pool;

casting the cast strip from the strip caster in which the at least two expansion rings are positioned within the cylindrical tube and the metal delivery system has formed the casting pool such that the cast strip is cast from the nip, the cast strip having a thickness defined by opposing faces of the cast strip and a width defined by the opposing first and second side edges of the cast strip (in certain instances the cast strip width is also defined by opposing side dams arranged between two casting rolls and define a width of the casting surfaces);

automatically measuring one or more thicknesses of the cast strip at least in close proximity to the first side edge using at least one sensor;

determining if the one or more thickness measured in close proximity to the first side edge of the cast strip indicate that the cast strip is too thick or too thin in close proximity to the first side edge; and, automatically decreasing live radial dimension of the expansion ring arranged in close proximity to the first side edge to cause the cylindrical tube to contract and increase the thickness of the cast strip during casting if it is determined that the cast strip is too thin in close proximity to the first side edge, or automatically increasing the radial dimension of the expansion ring arranged in close proximity to the first side edge to cause the cylindrical tube to expand and reduce the thickness of the cast strip during casting if it is determined that the cast strip is too thick in close proximity to the first side edge of the cast strip.

It is appreciated that such methods may be performed in different manners. Of particular note, the cast strip thickness may be measured only near one or both side edge of the cast strip or over a greater portion of the cast strip width. It is also appreciated that the cast strip thicknesses may be measured using any desired manner or mechanism(s), such as sensors, that measure thicknesses or distances that may be employed to determine the east strip thickness. It is also appreciated that the step of determining may be performed in different manners, by comparing measured and desired thicknesses in one or a plurality of locations across the width of the cast strip.

In specific variations of the methods detailed above, where in automatically measuring one or more thicknesses of the cast strip at least in close proximity to the first side edge using at least one sensor, a plurality of thicknesses of the cast strip are measured at least between the first side edge and a widthwise centerline of the cast strip. In such variations, in determining if the one or more thicknesses measured in close proximity to the first side edge of the cast strip indicate that the cast strip is too thick or too thin in close proximity to the first side edge, the plurality of thicknesses measured are curve fit into a polynomial function, and at a widthwise location of the cast strip in close proximity to the first side edge, the measured thickness is compared to the curve fit thickness at the widthwise location of the east strip in close proximity to the first side edge. If the measured thickness is greater than the curve fit thickness at the widthwise location in close proximity to the first side edge, the cast strip thickness in close proximity to the first side edge is too thick. If the measured thickness is less than the curve fit thickness at the widthwise location in close proximity to the first side edge, the cast strip thickness in close proximity to the first side edge is too thin. To improve accuracy, in certain instances, measuring at least between the first side edge and a widthwise centerline of the cast strip includes measuring the thickness of the cast strip in close proximity to the widthwise centerline.

With regard to the variations previously discussed, other variations thereof may be employed, such as where in automatically measuring one or more thicknesses of the cast strip at least in close proximity to the first side edge using at least one sensor, a plurality of thickness of the cast strip are measured between the first side edge and the second side of the cast strip, which also includes measuring the thickness of the cast strip in close proximity to the second side edge. Additionally, w here in determining if the one or more thicknesses measured in close proximity to the first side edge of the cast strip indicate that the east strip is too thick or too thin in close proximity to the first side edge, the plurality of thicknesses measured are curve fit into a polynomial function and at a widthwise location of the cast strip in close proximity to the first side edge and the measured thickness is compared to the curve fit thickness at the widthwise location in close proximity to the first side edge. If the measured thickness is greater than the curve fit thickness at the widthwise location in close proximity to the first side edge, the cast strip thickness in close proximity to the first side edge is too thick. If the measured thickness is less than the curve fit thickness at the widthwise location in close proximity to the first side edge, the cast strip thickness in close proximity to the first side edge is too thin.

With regard to any variation discussed previously, such methods may further include determining if the one or more thickness measured indicate that the cast strip is too thick or too thin in close proximity to the second side edge, where in determining if the one or more thicknesses measured in close proximity to the second side edge of the cast strip indicate that the east strip is too thick or too thin in close proximity to the second side edge, the plurality of thicknesses measured are curve fit into a polynomial function, and at a widthwise location of the cast strip in close proximity to the second side edge, the measured thickness is compared to the curve fit thickness at the widthwise location of the cast strip in close proximity to the second side edge. If the measured thickness is greater than the curve fit thickness at the widthwise location in close proximity to the second side edge, the cast strip thickness in close proximity to the first second edge is too thick. If the measured thickness is less than the curve fit thickness at die widthwise location in close proximity to the second side edge, the cast strip thickness in close proximity to the second side edge is too thin. Thereafter, the methods further include automatically decreasing the radial dimension of the expansion ring arranged in close proximity to the second side edge to cause the cylindrical tube to contract and increase the thickness of the cast strip during casting if it is determined that the cast strip is too thin in close proximity to the second side edge, or automatically increasing the radial dimension of the expansion ring arranged in close proximity to the second side edge to cause the cylindrical tube to expand and reduce the thickness of the east strip during casting if it is determined that the east strip is too thick in close proximity to the second side edge of the cast strip. It is appreciated that any desired polynomial function may be employed, such as, and without limitation, a parabolic function. Any such curve fit may be determined using any known technique, such as by way of regression. In the case of a parabolic function, the curve fit is accomplished using a quadratic regression technique.

In other variations, such methods may further include: automatically measuring one or more thicknesses of the cast strip at least in close proximity to the second side edge using at least one sensor, determining if the one or more thickness measured in close proximity to the second side edge of the cast strip indicate that the cast strip is too thick or too thin in close proximity to the second side edge: and, automatically decreasing the radial dimension of the expansion ring arranged in close proximity to the second side edge to cause the cylindrical tube to contract and increase the thickness of the cast strip during casting if it is determined that the cast strip is too thin in close proximity to the second side edge, or automatically increasing the radial dimension of the expansion ring arranged in close proximity to the second side edge to cause the cylindrical tube to expand and reduce the thickness of the cast strip during casting if it is determined that the cast strip is too thick in close proximity to the second side edge of the cast strip. Measuring the thickness in close proximity to any side edge of the cast strip (whether a first or second side edge) is generally performed at one or more locations arranged 0 to 150 millimeters (mm) from the corresponding side edge of the cast strip, or, one or more locations arranged from the corresponding side edge of the cast strip a distance equal to 0 to 15% of the cast strip width. While the east strip width may comprise any desired width, in certain instances, the cast strip width is 1000 to 3000 millimeters.

In certain instances, automatically measuring a thickness of the cast strip in close proximity to the second side edge includes: measuring the cast strip thickness at a first location relative to the second side edge and measuring the cast strip thickness at a second location relative to the second side edge, the second location being closer to the second side edge than the first location, where each of the thicknesses measured at the first and second locations are automatically compared to respective target thicknesses to determine whether the cast strip in close proximity to the second side edge is too thin or too thick. In certain instances, where in comparing the thicknesses measured at the first and second locations to respective target thicknesses, a difference between the thicknesses measured at the first and second locations is automatically determined to measure a thickness profile, and where the measured thickness profile is compared to a target thickness profile to determine whether the profile measured indicates that the thickness of the cast strip is too thin or too thick. This difference or thickness profile is referred to as the edge drop. More specifically, the edge drop is determined by subtracting the thickness T2 measured at the second location (P2) from the thickness T1 measured at the first location (P1), which car be expressed as T1−T2 m edge drop. It is appreciated that the target edge drop may be zero (0) (where T1=T2) or may be positive (that is, when: T1>T2). In certain instances, the target thickness profile, or target edge drop, is substantially 50 to 100 microns (μm), although it is appreciated that any target thickness profile may be utilized as desired. While the first and second locations may be arranged any distance in close proximity to the second side edge as desired in specific situations, such as where the target edge drop is 50 to 100 microns, for example, the first location is arranged 75 to 125 mm from the second side edge and the second location is arranged 0 to 50 mm from the second side edge in the direction of the cast strip width. In other situations, the first location is 90 mm to 110 mm, or 100 mm, from the second side edge and the second location is 15 mm to 35 mm, or 25 mm, from the second side edge. Stated differently, in measuring the thickness in close proximity to the second side edge of the cast strip, the thickness may be measured at a first location arranged a distance from the second side edge equal to 3.75-12.5% or 4.5-11% of the cast strip width or of the casting surface width, while the thickness may be measured at a second location arranged a distance from the second side edge equal to 0-5% or 0.75-3.5% of the cast strip width or of the casting surface width.

With regard to the second side edge, in certain instances, automatically measuring a thickness of the cast strip in close proximity to the first side edge includes: measuring the cast strip thickness at a first location relative to the first side edge and measuring the cast strip thickness at a second location relative to the first side edge, the second location being closer to the first side edge titan the first location, where each of the thicknesses measured at the first and second locations are automatically compared to respective target thicknesses to determine whether the cast strip in close proximity to the first side edge is too thin or too thick. In certain instances, where in comparing the thicknesses measured at the first and second locations to respective target thicknesses, a difference between the thicknesses measured at the first and second locations is automatically determined to measure the thickness profile, and where the measured thickness profile is compared to a target thickness profile to determine whether the profile measured indicates that the thickness of the cast strip is too thin or too thick. Again, this difference or thickness profile is referred to as the edge drop, as described above. As with the second side edge, in certain instances, the target thickness profile, or target edge drop, is substantially 50 to 100 microns (μm), although it is appreciated that any target thickness profile may be utilized as desired. While the first and second locations may be arranged any distance in close proximity to the second side edge as desired, in specific situations, such as where the target edge drop is 50 to 100 microns, for example, the first location is arranged 75 to 125 mm from the second side edge and the second location is arranged 0 to 50 mm from the second side edge in the direction of the cast strip width. In other situations, the first location is 90 mm to 110 mm, or 100 mm, from the second side edge and the second location is 15 mm to 35 mm, or 25 mm, from the second side edge. Stated differently, in measuring the thickness in close proximity to the second side edge of the cast strip, the thickness may be measured at a first location arranged a distance from the second side edge equal to 3.75-12.5% or 4.5-11% of the cast strip width or of the casting surface width, while the thickness may be measured at a second location arranged a distance from the second side edge equal to 0-5% or 0.75-3.5% of the cast strip width or of the casting surface width.

To facilitate automatic performance of various steps in such methods, it is appreciated that in certain instances, each of any one or more sensors are in communication with a logic controller to automatically perform any recited steps concerning any of the measured thicknesses. Likewise, any such logic controller may also be in communication with any expansion ring for the purpose of controlling the expansion and contraction of such expansion ring. A memory device may also be employed in communication with the logic controller to store instructions for performing such methods in whole or in part.

It is appreciated that the expansion rings may expand and contract in any desired manner. For example, any expansion ring may expand and contract mechanically, such as by using any desired actuator. By further example, any expansion ring may expand and contract based upon principles of thermal expansion, where each expansion ring expands and contracts by controlling the temperature of each such ring. This may ultimately be performed by controlling the power (e.g., electrical) applied to each such ring. For example, in certain variations, each such expansion ring has at least one heating element and an insulating coating thereon and adapted to increase in radial dimension causing the cylindrical tube to expand and change roll crown of the casting surfaces of the casting rolls and thickness profile of the cast strip during casting. Each expansion ring may have at least one heating element that may be made of stainless steel, nickel or nickel alloy. The heating element or elements may be located as desired in each expansion ring. Each expansion ring may provide a heating input of up to 30 kW; preferably, of at least 3 kW. It is appreciated that the amount of power applied to the expansion rings may be varied based on the feedback from the at least one sensor, said sensor or sensors capable of sensing at least one of the following properties:

- temperature of the strip, such as in close proximity to the nip from which the strip is cast;
- temperature of the expansion ring or rings,
- thickness profile of the casting downstream.
- local thickness of the cast strip at a defined spot close to the cast strip edges.
- casting roll surface crown during the casting campaign, and
- radial casting roll expansion at a defined spot close to the cast strip edges;

and capable of generating digital or analogous (typically electrical) signals indicative of at least one of the above mentioned properties of the cast strip. The effect of ring expansion is to increase or decrease the outer diameter of any casting roll along the casting surface, the expansion or contraction of the roll being greatest at the location of the expansion ring but where such effects decrease as the distance from the expansion ring increases along the casting surface (such as until approaching another expansion ring and its effects on the casting roll outer diameter).

In utilizing the temperature of the strip to control the thickness of the cast strip, such as at or near the side edges of the cast strip, the temperature may be measured at any desired location across the width of the cast strip from a location in close proximity to the nip to a location up to a first set of pinch rollers. In measuring the temperature in close proximity to the nip, the measurement may be taken a distance of 0 to 5 meters (m) from the nip in the direction of the cast strip length. In measuring the temperature of the cast strip, a temperature profile may be measured across the width of the strip by taking measurements at any of a plurality of locations. By measuring the temperature of the strip, information may be obtained identifying locations across the width where too much squeeze is taking place as well as locations where there is not enough squeeze taking place. When the squeezing near the edges becomes too high relative to the more central widthwise locations of the strip, an excessive amount of liquid mushy will pass through the nip across the center of the strip. This leads to high crow n and ridges, and in extreme cases will cause the strip to break. In locations where there is too much squeeze in close proximity to a side edge of the cast strip, a localized cold spot near a side edge will be identified with elevated temperatures located in the center, at which time the ring temperatures would be decreased—even if the edge drop was too low.

Care should be taken to have an insulating coating on each expansion ring sufficiently thick in order to control or eliminate heat transfer from the expansion rings to the casting rolls. An insulating coating of at least 0.010 inch in thickness (e.g. 0.025 mm) is necessary to have an effective control of heat transfer from the expansion ring to the casting roll. The insulating coating may be plasma sprayed on the expansion rings. The insulating coating may be plasma sprayed with zirconia spray such as 8% Yttria stabilized zirconia spray. Note that the insulating coating may additionally be applied to the cylindrical tube, but for economy and effectiveness the insulating coating should be applied to the expansion rings directly.

The expansion rings may also have water passages there through allowing water to flow through the rings. The water flowing through the expansion rings may be regulated to expand or contract the expansion rings in radial dimension and, in turn, to increase or decrease the diameter of the cylindrical tube as desired to control the crown shape of the casting surfaces of the casting rolls during a campaign.

Moreover, the method of continuously casting thin strip by controlling roll crown may further comprise the step of controlling casting roll drive to vary the speed of rotation of the casting rolls while varying the radial dimension of the expansion rings responsive to at least one of the digital or analogous signals received from the at least one sensor and control roll crown of the casting surfaces of the casting rolls during the casting campaign.

Additionally, the method of continuously casting thin strip by controlling roll crown may further comprise the step of positioning at least one expansion ring (e.g. up to 15 expansion rings) corresponding to the center portions of die cast strip formed on the casting rolls during casting, each expansion ring having at least one heating element and an insulating coating thereon and adapted to increase and decrease radial dimension causing the cylindrical tube to expand and contract changing crown of the casting surfaces of the casting rolls and the thickness profile of the cast strip during casting. Furthermore, the method of continuously casting thin strip by controlling roll crown may include the step of controlling casting roll drive to vary the speed of rotation of the casting rolls, while varying the radial dimension of the expansion rings with insulating coating spaced from the edge portions of the cast strip and the radial dimension of the expansion ring or rings with insulating coating corresponding to center portions of the cast strip responsive to electrical signals received from a sensor to control the roll crown of the casting surfaces of the casting rolls during the casting campaign.

In each embodiment, the expansion rings may be made of an austenitic stainless steel such as 18/8 austenitic stainless steel. Each expansion ring may have an annular dimension between 50 to 150 millimeters; preferably, 70 millimeters. Each expansion ring may have a width of up to 200 millimeters; such as up to 100 mm, or such as 67 millimeters.

In each embodiment of the method, the crown of the casting surfaces of the casting rolls can readily be varied to achieve a desired thickness profile of the cast strip. Each expansion ring with an insulating coating thereon is adapted to increase or decrease in radial dimension and cause the cylindrical tube to expand changing crown of the casting surfaces of the casting rolls and the thickness profile of the cast strip. The thickness of the cylindrical tube may range between 40 and 80 millimeters in thickness or between 60 and 80 millimeters in thickness.

In each embodiment of the method, at least one sensor may be positioned downstream of the nip and adapted to sense the thickness profile of the east strip and to generate electrical signals indicative of the thickness profile of the cast strip. The sensor may be located adjacent to pinch rolls through which the strip passes after casting.

The radial dimension of each expansion ring may be controlled independently from the radial dimension of the other expansion ring or rings. The radial dimension of the expansion rings adjacent the strip edges on the casting surfaces of the casting rolls may be controlled independently from each other. Additionally, the radial dimension of the expansion rings adjacent the strip edges on the casting surfaces of the casting rolls may be controlled independently from the expansion ring or rings corresponding to the center portions of the cast strip.

In certain embodiments, at least two expansion rings are arranged in each cylindrical tube for each of the pair of casting rolls. While each expansion ring in one casting roll may be arranged at a substantially identical axial location relative to a corresponding expansion ring in the other casting roll of a pair of casting rolls, such as with regard to expansion rings arranged in close proximity to side edges of a cast strip or of a casting surface, in particular instances, to offer more flexibility in controlling the cast strip thickness, at least one expansion ring in one casting roll may be arranged at a different axial location relative to a corresponding expansion ring in the other casting roll. This is regardless as to whether the expansion rings in any casting roll are symmetrically or asymmetrically arranged within the casting roll. For example, in certain instances, at least two expansion rings arranged in one tube of the cylindrical tubes are arranged closer to a centerline of the tube than the at least two expansion rings arranged in the other tube of the pair of cylindrical tubes.

Also disclosed is an apparatus for continuously casting thin strip comprising:

- a pair of counter rotating casting rolls with a nip there between capable of delivering cast strip downwardly from the nip, each casting roll having a casting surface formed by a cylindrical tube having thickness of no more titan 80 millimeters and formed of a material selected from the group consisting of copper and copper alloy, optionally with a metal or metal alloy coating thereon, and having a plurality of longitudinal water flow passages extending through the cylindrical tube;
- at least two expansion rings positioned within the cylindrical tube for any casting roll of the pair of casting rolls and each in close proximity to one of opposing first and second side edges of the cast strip formed on opposite end portions of the casting rolls during a casting campaign, each expansion ring having at least one heating element and an insulating coating thereon and adapted to increase and decrease in radial dimension causing the cylindrical tube to expand and contract, respectively, to thereby change the thickness of the cast strip during casting;
- a metal delivery system positioned above the nip and capable of forming a casting pool supported on the casting surfaces of the casting rolls with side dams adjacent ends of the nip to confine the casting pool;
- one or more sensors arranged after the nip configured to measure one or more thicknesses of the cast strip; and
- a logic controller configured to perform stored instructions for performing any step in the methods discussed herein, such as, for example, automatically perform stored instructions to determine if a measured thickness of the cast strip thickness is too thin or too thick as contemplated herein.

It will be appreciated that the apparatus may include any feature, structure, or variation discussed in association with the method above or otherwise herein, and which may be configured to perform any such identified purpose. Likewise, for die apparatus, the logic controller may be configured to perform any stored instruction to perform any such identified purpose. As noted elsewhere, a storage device may also be employed, in communication with the logic controller, to store instructions for performing any intended function of the apparatus.

For example, in certain instances, where the logic controller, in being configured to automatically perform stored instructions to determine if a measured thickness of the cast strip is too thin or too thick. In particular instances, the stored instructions include: instructions for automatically measuring one or more thicknesses of the cast strip at least in close proximity to the first side edge using at least one sensor; instructions for determining if the one or more thickness measured in close proximity to the first side edge of the cast strip indicate that the cast strip is too thick or too thin in close proximity to the first side edge; and, instructions for automatically decreasing the radial dimension of the expansion ring arranged in close proximity to the first side edge to cause the cylindrical tube to contract and increase the thickness of the cast strip during casting if it is determined that the cast strip is too thin in close proximity to the first side edge, or instructions for automatically increasing the radial dimension of the expansion ring arranged in close proximity to the first side edge to cause the cylindrical tube to expand and reduce the thickness of the cast strip during casting if it is determined that the cast strip is too thick in close proximity to the first side edge of the cast strip.

Additionally or separately, in certain instances, the stored instructions for automatically measuring a thickness of the cast strip in close proximity to the second side edge may include measuring the cast strip thickness at a first location relative to the second side edge and measuring the cast strip thickness at a second location relative to the second side edge, the second location being closer to the second side edge than the first location, where each of the thicknesses measured at the first and second locations are automatically compared to respective target thicknesses to determine whether the cast strip in close proximity to the second side edge is too thin or too thick. In certain instances, where in comparing the thicknesses measured at the first and second locations to respective target thicknesses, a difference between the thicknesses measured at the first and second locations is automatically determined to measure a thickness profile, and where the measured thickness profile is compared to a target thickness profile to determine whether the profile measured indicates that the thickness of the cast strip is too thin or too thick.

Additionally or separately, in certain instances, the stored instructions for automatically measuring a thickness of the cast strip thickness in close proximity to the second side edge provide that the first location is arranged 75 to 125 mm from the second side edge and the second location is arranged 0 to 50 mm from the second side edge in the direction of the cast strip width. Instructions for automatically measuring a thickness as described in other variations elsewhere herein, including those discussed in association with the method, may be employed as desired.

Additionally or separately, in certain instances, where the stored instructions for automatically measuring a thickness of the cast strip in close proximity to the first side edge include measuring the cast strip thickness at a first location relative to the first side edge and measuring the cast strip thickness at a second location relative to the first side edge, the second location is closer to the first side edge than the first location, where each of the thicknesses measured at the first and second locations are automatically compared to respective target thicknesses to determine whether the cast strip in close proximity to the first side edge is too thin or too thick. In certain instances, where in comparing the thicknesses measured at the first and second locations to respective target thicknesses, a difference between the thicknesses measured at the first and second locations is automatically determined to measure a thickness profile, and the measured thickness profile is compared to a target thickness profile to determine whether the profile measured indicates that the thickness of the cast strip is too thin or too thick. These first and second locations may each be any desired location, although in certain embodiments, such as those discussed previously or otherwise herein, the first location is arranged 75 to 125 mm from the second side edge and the second location is arranged zero to 50 mm from the first side edge in the direction of the cast strip width. Instructions for automatically measuring a thickness as described in other variations elsewhere herein, including those discussed in association with the method, may be employed as desired.

The expansion rings may each operate as desired to expand and contract, such as by way of mechanical principles. For example, in certain instances, each of the expansion rings is configured to expand and contract based upon principles of thermal expansion, where each expansion ring is configured to expand and contract by controlling the temperature of each such ring.

Various aspects of the invention will become apparent to those skilled in the art from the following detailed description, drawings and claims.

BRIEF DESCRIPTION OF THE DRAWINGS

The invention is described in more detail in reference to the accompanying drawings in which.

DETAILED DESCRIPTION OF THE DRAWINGS

Figure 1:
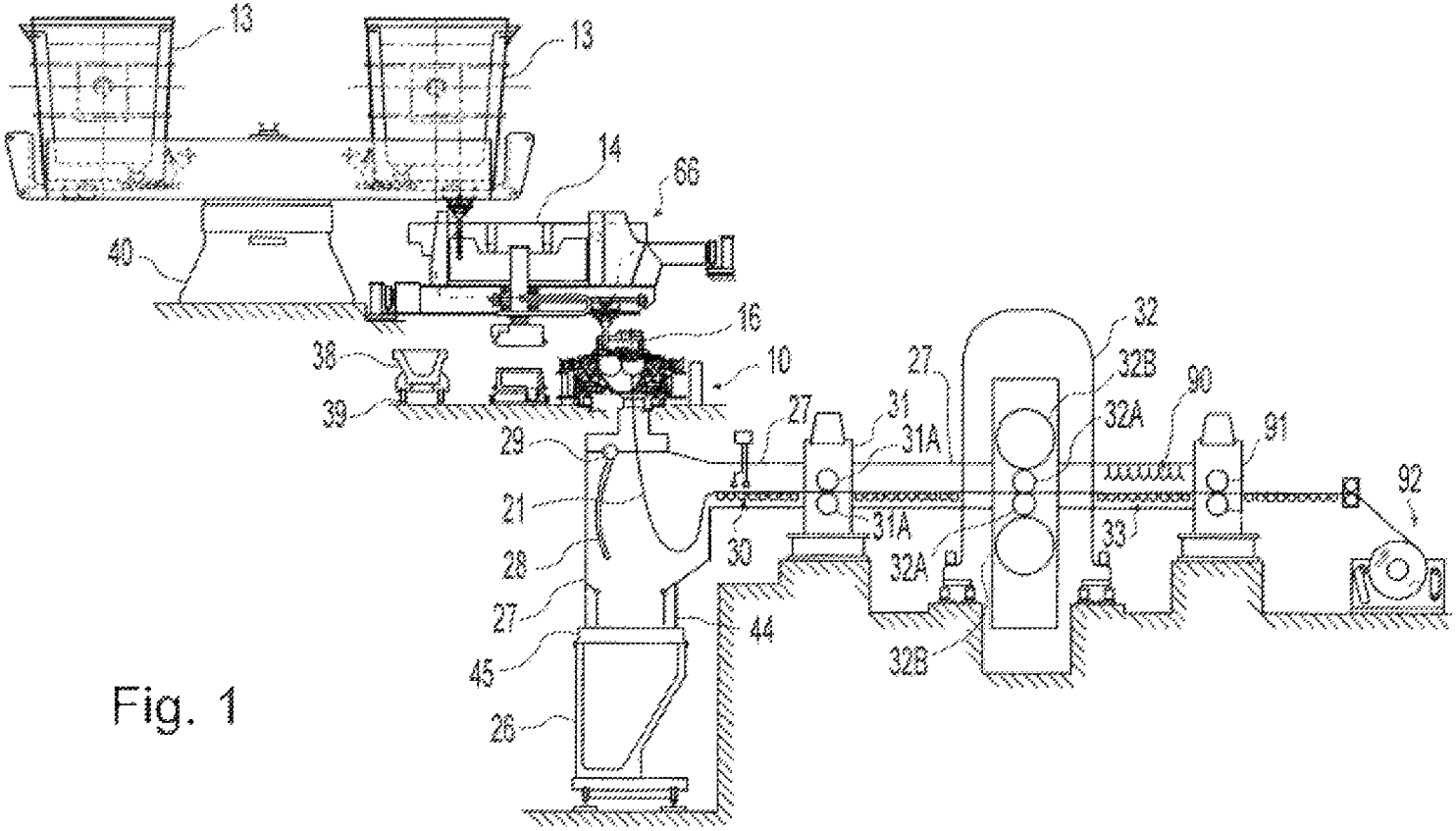
FIG. 1 is a diagrammatical side view of a twin roll caster of the present disclosure.
Figure 2:
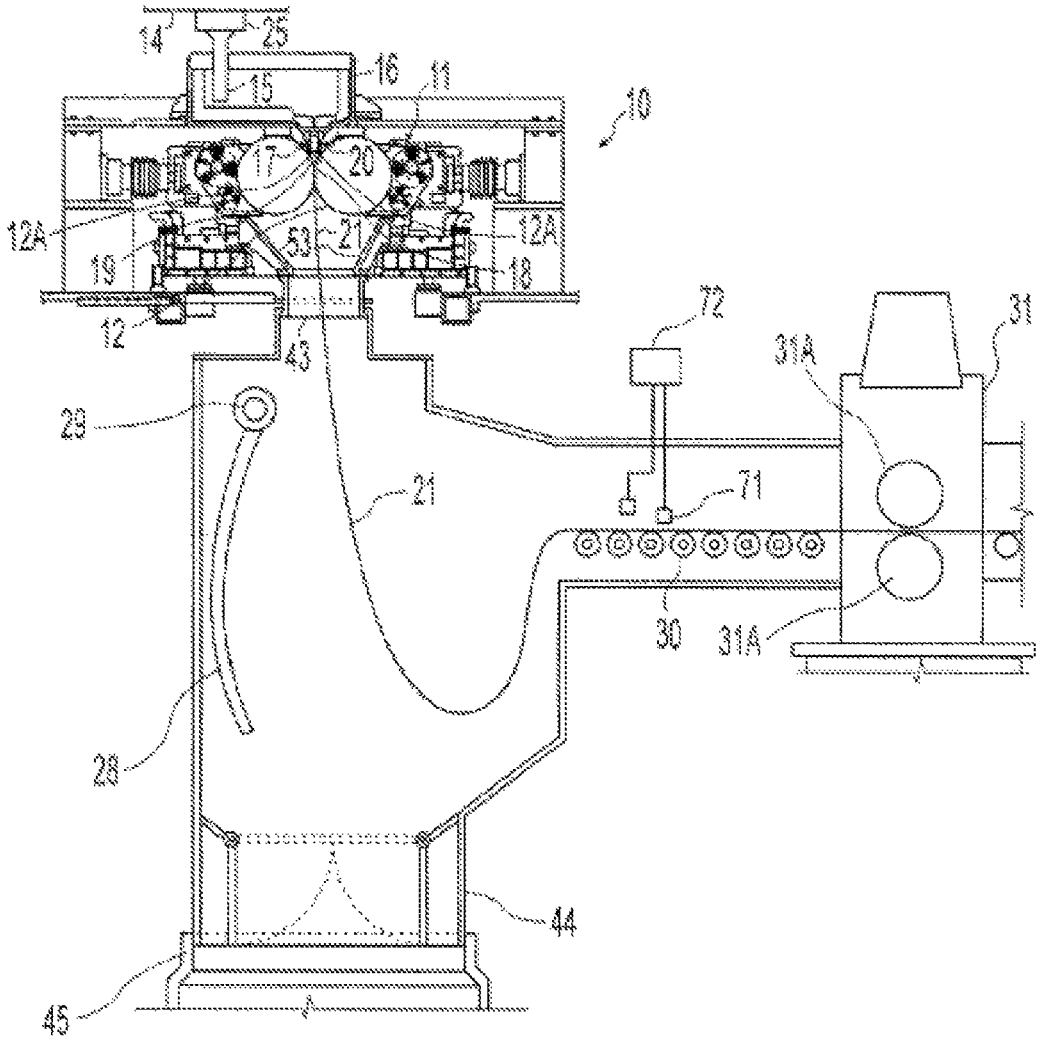
FIG. 2 is an enlarged partial sectional view of a portion of the twin roll caster of FIG. 1 including a strip inspection device for measuring strip profile.
Figure 2A:
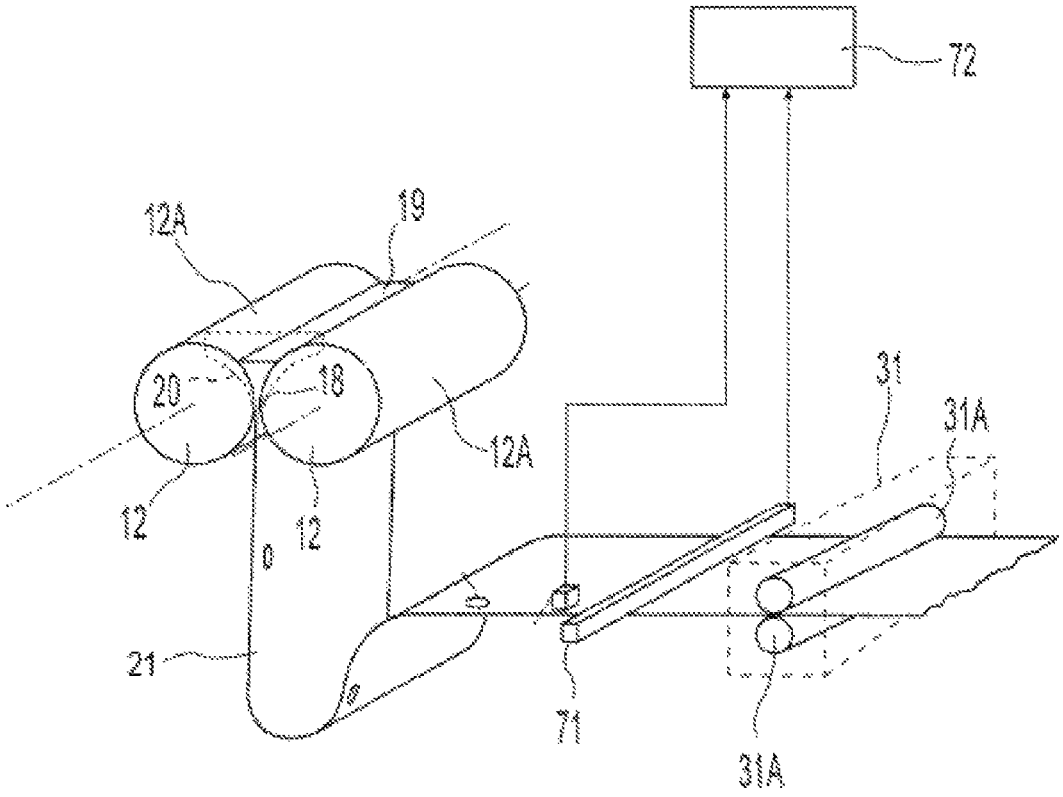
FIG. 2A is a schematic view of a portion of twin roll caster of FIG. 2.

Referring now to FIGS. 1, 2, and 2A, a twin roll caster is illustrated that comprises a main machine frame 10 that stands up from the factory floor and supports a pair of counter-rotatable casting rolls 12 mounted in a module in a roll cassette 11. The casting rolls 12 are mounted in the roll cassette 11 for ease of operation and movement as described below. The roll cassette 11 facilitates rapid movement of the casting rolls 12 ready for casting from a setup position into an operative casting position as a unit in the caster, and ready removal of the casting rolls 12 from the casting position when the casting rolls 12 are to be replaced. There is no particular configuration of the roll cassette 11 that is desired, so long as it performs that function of facilitating movement and positioning of the casting rolls 12 as described herein.

The casting apparatus for continuously casting thin steel strip includes the pair of counter-rotatable casting rolls 12 having casting surfaces 12A laterally positioned to form a nip 18 there between. Molten metal is supplied from a ladle 13 through a metal delivery system to a metal delivery nozzle 17 (core nozzle) positioned between the casting mils 12 above the nip 18. Molten metal thus delivered forms a casting pool 19 of molten metal above the nip 18 supported on the casting surfaces 12A of the casting rolls 12. This casting pool 19 is confined in the casting area at the ends of the casting rolls 12 by a pair of side closure plates, or side dams 20 (shown in dotted line in FIG. 2A). The upper surface of the casting pool 19 (generally referred to as the "meniscus" level) may rise above the lower one of the delivery nozzle 17 so that the lower end of the delivery nozzle 17 is immersed within the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish 14 with molten metal. The movable tundish 14 may be positioned on a tundish car 66 capable of transferring the tundish 14 from a heating station (not shown), where the tundish 14 is healed to near a casting temperature, to the casting position. A tundish guide, such as rails 39, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 13 to a transition piece or distributor 16 in the casting position. From the distributor 16, the molten metal flows to the delivery nozzle 17 positioned between the casting rolls 12 above the nip 18.

The side dams 20 may be made from a refractory material such as zirconia graphite, graphite alumina, boron nitride, boron nitride-zirconia, or other suitable composites. The side dams 20 have a face surface capable of physical contact with the casting rolls 12 and molten metal in the casting pool 19. The side dams 20 are mounted in side dam holders (not shown), which are movable by side dam actuators (not show n), such us a hydraulic or pneumatic cylinder, servo mechanism, or other actuator to bring the side dams 20 into engagement with the ends of the casting rolls 12. Additionally, the side dam actuators are capable of positioning the side dams 20 during casting. The side dams 20 form end closures for the molten pool of metal on the casting rolls 12 during the casting operation.

FIG. 1 shows the twin roll caster producing the cast strip 21, which passes across a guide table 30 to a pinch roll stand 31, comprising pinch rolls 31A. Upon exiting the pinch roll stand 31, the thin cast strip 21 may pass through a hot rolling mill 32, comprising a pair of work mils 32A, and backup rolls 32B, forming a gap capable of hot rolling the cast strip 21 delivered from the casting rolls 12, where the cast strip 21 is hot rolled to reduce the strip to a desired thickness, improve the strip surface, and improve the strip flatness. The work rolls 32A have work surfaces relating to the desired strip profile across the work rolls 32A. The hot rolled cast strip 21 then passes onto a run-out table 33, where it may be cooled by contact with a coolant, such as water, supplied via water jets 90 or other suitable means, and by convection and radiation. In any event, the hot rolled cast strip 21 may then pass through a second pinch roll stand 91 to provide tension of the cast strip 21, and then to a coiler 92. The cast strip 21 may be between about 0.3 and 2.0 millimeters in thickness before hot rolling.

At the start of the casting operation, a short length of imperfect strip is typically produced as casting conditions stabilize. After continuous casting is established, the casting rolls 12 are moved apart slightly and then brought together again to cause this leading end of the cast strip 21 to break away forming a clean head end of the following cast strip 21. The imperfect material drops into a scrap receptacle 26, which is movable on a scrap receptacle guide. The scrap receptacle 26 is located in a scrap receiving position beneath the caster and forms part of a scaled enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a bop beneath the casting rolls 12 in enclosure 27 before it passes to the guide table 30 where it engages a succession of guide rollers.

An overflow container 38 may be provided beneath the movable tundish 14 to receive molten material that may spill from the tundish 14. As shown in FIG. 1, the overflow container 38 may be movable on rails 39 or another guide such that the overflow container 38 may be placed beneath the movable tundish 14 as desired in casting locations. Additionally, an optional overflow container (not shown) may be provided for the distributor 16 adjacent the distributor 16.

The scaled enclosure 27 is formed by a number of separate wall sections that lit together at various seal connections to form a continuous enclosure wall that permits control of the atmosphere within the enclosure 27. Additionally, the scrap receptacle 26 may be capable of attaching with the enclosure 27 so that the enclosure 27 is capable of supporting a protective atmosphere immediately beneath the casting rolls 12 in the casting position. The enclosure 27 includes an opening in the lower portion of the enclosure 27, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed." "sealing." and "sealingly" in reference to the scrap receptacle 26, enclosure 27, and related features may not be a complete seal so as to prevent leakage, but rather is usually less than a perfect seal as appropriate to allow control and support of the atmosphere within the enclosure 27 as desired with some tolerable leakage.

A rim portion 45 may surround the opening of the lower enclosure portion 44 and may be movably positioned above the scrap receptacle 26, capable of sealingly engaging and/or attaching to the scrap receptacle 26 in the scrap receiving position. The rim portion 45 may be movable between a sealing position in which the rim portion 45 engages the scrap receptacle 26, and a clearance position in which the rim portion 45 is disengaged from the scrap receptacle 26. Alternately, the caster or the scrap receptacle 26 may include a lifting mechanism to raise the scrap receptacle 26 into scaling engagement with the rim portion 45 of the enclosure 27, and then lower the scrap receptacle 26 into the clearance position. When sealed, the enclosure 27 and scrap receptacle 26 are filled with a desired gas, such as nitrogen, to reduce the amount of oxygen in the enclosure 27 and provide a protective atmosphere for the cast strip 21.

The enclosure 27 may include an upper collar portion 43 supporting a protective atmosphere immediately beneath the casting rolls 12 in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls 12, and may be moved by a plurality of actuators (not shown) such as servo-mechanisms, hydraulic mechanisms, pneumatic mechanisms, and rotating actuators.

The casting rolls 12 are internally water cooled as described below so that as the casting rolls 12 are counter-rotated, shells solidify on the casting surfaces 12A, as the casting surfaces 12A move into contact with and through the casting pool 19 with each revolution of the casting rolls 12. The shells are brought close together at the nip 18 between the casting rolls 12 to produce a thin cast strip product 21 delivered downwardly from the nip 18. The thin cast strip product 21 is formed from the shells at the nip IS between the casting rolls 12 and delivered downwardly and moved downstream as described above.

Referring now to FIGS. 3A-10, each carting roll 12 includes ft cylindrical tube 120 of a metal selected from the group consisting of copper and copper alloy, optionally with a metal or metal alloy coating thereon, e.g., chromium or nickel, to form the casting surfaces 12A. Each cylindrical tube 120 may be mounted between a pair of stub shaft assemblies 121 and 122. The stub shaft assemblies 121 and 122 have end portions 127 and 128, respectively (shown in FIGS. 4-6), which fit snugly within the ends of cylindrical tube 120 to form the casting roll 12. The cylindrical tube 120 is thus supported by end portions 127 and 128 having flange portions 129 and 130, respectively, to form internal cavity 163 therein, and support the assembled casting roll between the stub shaft assemblies 121 and 122.

The outer cylindrical surface of each cylindrical tube 120 is a roll casting surface 12A. The radial thickness of the cylindrical tube 120 may be no more than 80 millimeters thick. The thickness of the tube 120 may range between 40 and 80 millimeters in thickness or between 60 and 80 millimeters in thickness.

Each cylindrical tube 120 is provided with a series of longitudinal water flow passages 126, which may be formed by drilling long holes through the circumferential thickness of the cylindrical tube 120 from one end to the other. The ends of the holes are subsequently closed by end plugs 141 attached to the end portions 127 and 128 of stub shaft assemblies 121 and 122 by fasteners 171. The water flow passages 126 are formed through the thickness of the cylindrical tube 120 with end plugs 141. The number of stub shaft fasteners 171 and end plugs 141 may be selected as desired. End plugs 141 may be arranged to provide, with water passage in the stub shaft assemblies described below, in single pass cooling from one end to the other of the casting roll 12, or alternatively, to provide multi-pass cooling where, for example, the flow passages 126 are connected to provide three passes of cooling water through adjacent flow passages 126 before returning the water to the water supply directly or through the cavity 163.

The water flow passages 126 through the thickness of the cylindrical tube 120 may be connected to water supply in series with cavity 163. The water passages 126 may be connected to the water supply so that the cooling water first passes through cavity 163 and then the water supply passages 126 to the return lines, or first through the water supply passages 126 and then through cavity 163 to the return lines.

The cylindrical tube 120 may be provided with circumferential steps 123 at end to form shoulders 124 with the working portion of the roll casting surface 12A of the casting roll 12 there between. The shoulders 124 are arranged to engage the side dams 20 and confine the casting pool 19 as described above during the casting operation.

Figure 4:
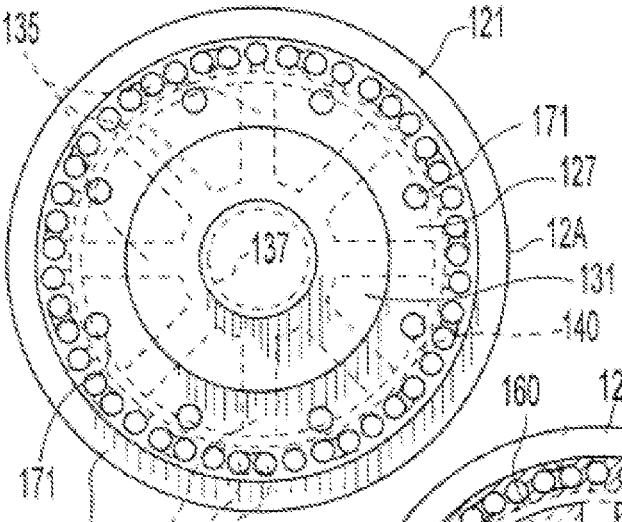
FIG. 4 is an end view of the casting roll of FIG. 3A on line 4-4 shown in partial interior detail in phantom.
Figure 5:
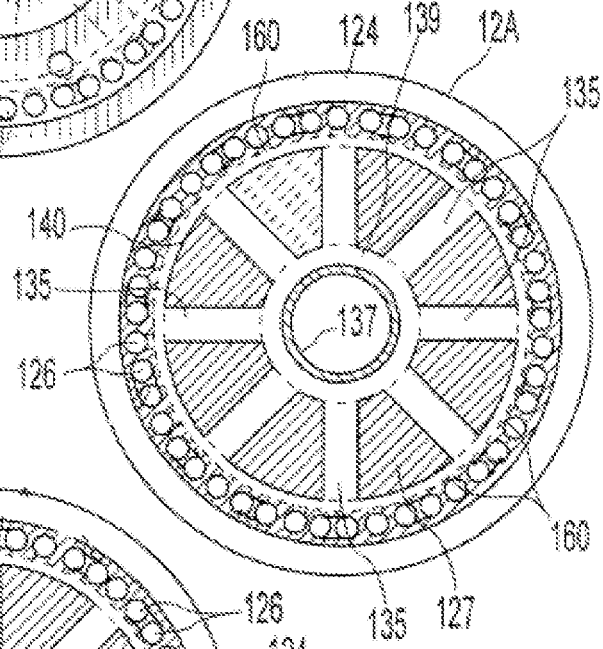
FIG. 5 is a cross sectional view of the casting roll of FIG. 3A on line 5-5.
Figure 6:
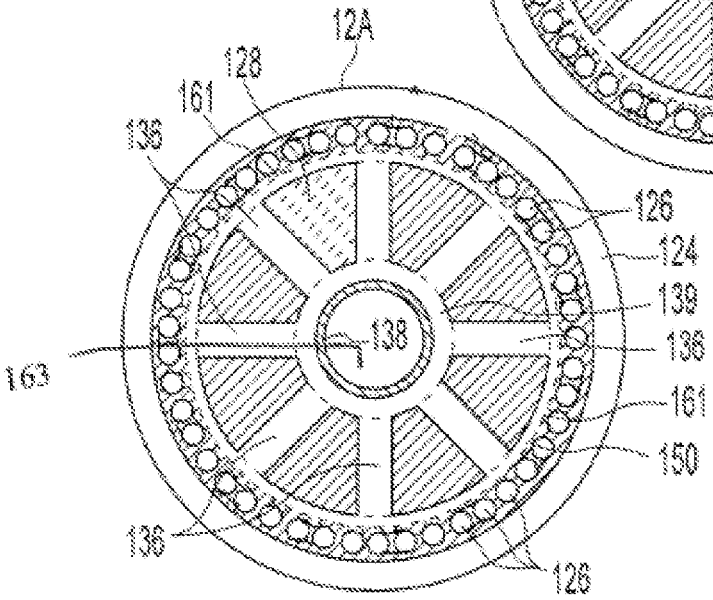
FIG. 6 is a cross sectional view of the casting roll of FIG. 3A on line 6-6.

End portions 127 and 128 of stub shaft assemblies 121 and 122, respectively, typically sealingly engage the aids of cylindrical tube 120 and have radially extending water passages 135 and 136 shown in FIGS. 4-6 to deliver water to the water flow passages 126 extending through the cylindrical tube 120. The radial flow passages 135 and 136 are connected to the ends of at least some of the water flow passages 126, for example, in threaded arrangement, depending on whether the cooling is a single pass or multi-pass cooling system. The remaining ends of the water flow passages 126 may be closed by for example, threaded end plugs 141 as described where the water cooling is a multi-pass system.

Figure 7:
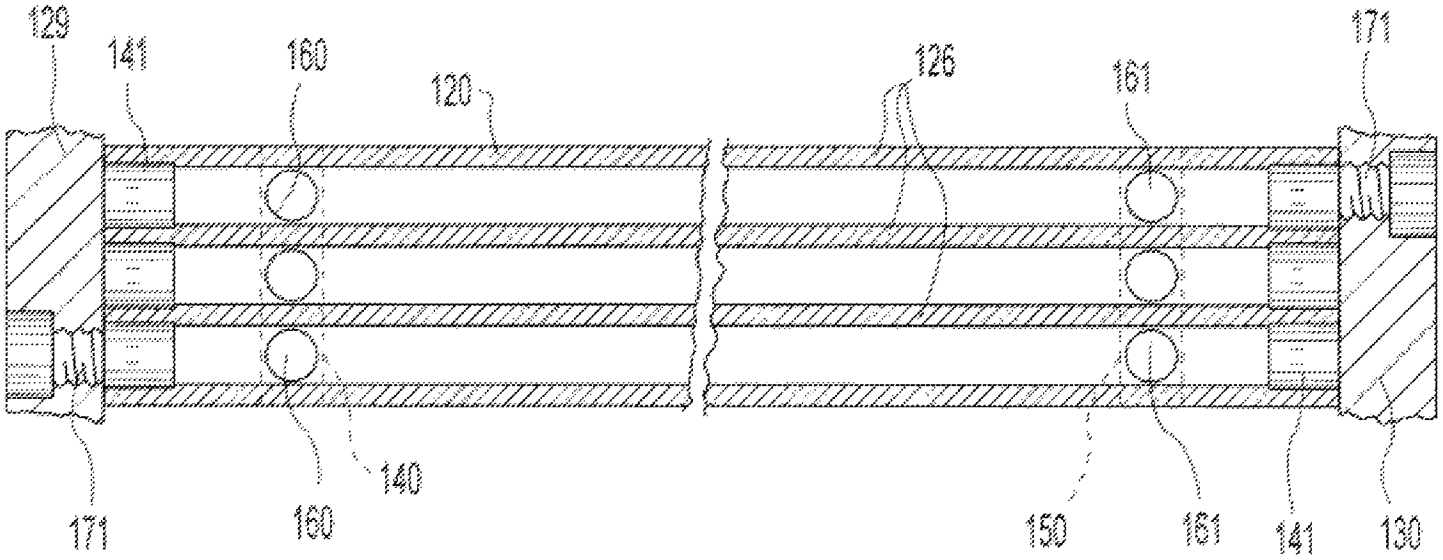
FIG. 7 is a cross sectional view of the casting roll of FIG. 3A on line 7-7.

As shown in detail by FIG. 7, water flow passages 126 may be positioned in annular arrays in the thickness of cylindrical tube 120 either in single pass or multi-pass arrays of water flow passages 126 as desired. The water flow passages 126 are connected at one end of the casting roll 12 by radial ports 160 to the annular gallery 140 and in turn radially flow passages 135 of end portion 127 in stub shaft assembly 121, and are connected at the other end of the casting roll 12 by radial ports 161 to annular gallery 150 and in turn radial flow passages 136 of end portions 128 in stub shaft assembly 121. Water supplied through one annular gallery, 140 or 150, at one end of the roll 12 can flow in parallel through all of the water flow passages 126 in a single pass to the other end of the roll 12 and out through the radial passages, 135 or 136, and the other annular gallery 150 or 140, at that other end of the cylindrical tube 120. The directional flow may be reversed by appropriate connections of the supply and return line(s) as desired. Alternatively or additionally, selective ones of the water flow passages 126 may be optionally connected or blocked from the radial passages 135 and 136 to provide a multi pass arrangement, such as a three pass arrangement.

Figure 3A:
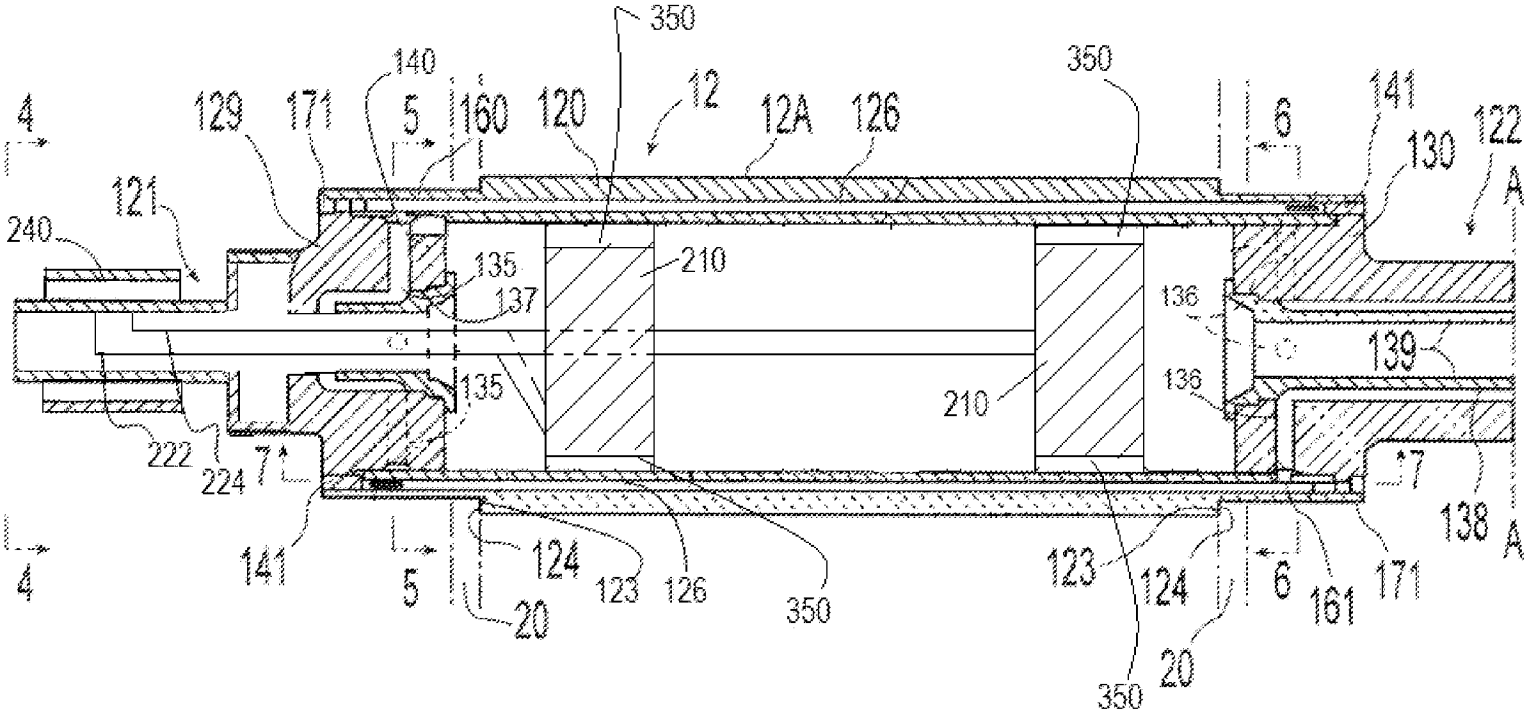
FIG. 3A is a cross sectional view longitudinally through a portion of one of the casting rolls of FIG. 2 with two expansion rings spaced from the edge portions of the cast strip.
Figure 3B:
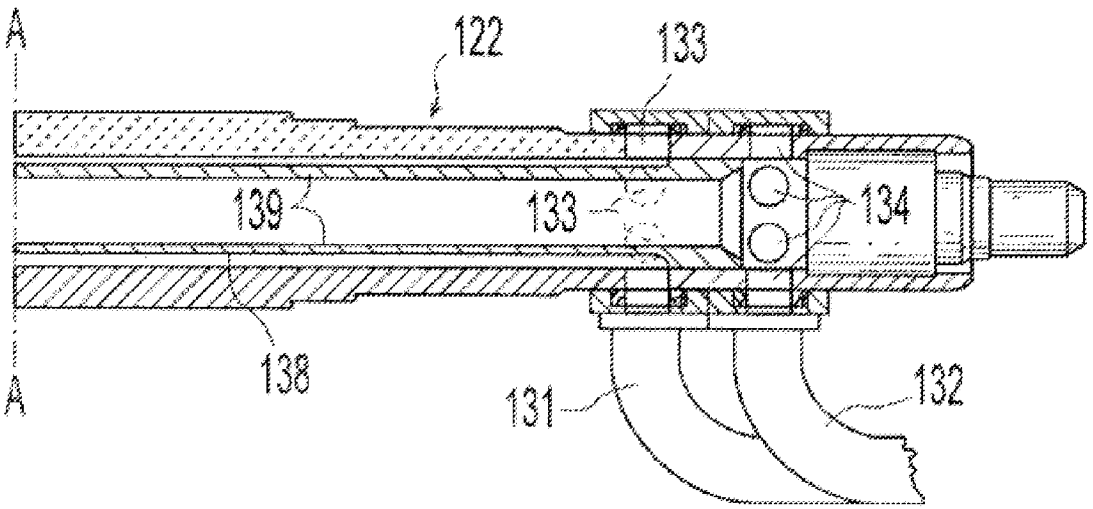
FIG. 3B is a cross sectional view longitudinally through the remaining portion of the casting roll of FIG. 3A joined on line A-A.

The stub shaft assembly 122 may be longer than the stub shaft assembly 121. As illustrated in FIG. 3B, the stub shaft assembly 122 may be provided with two sets of water How ports 133 and 134. Water flow ports 133 and 134 are capable of connection with rotary water flow couplings 131 and 132 by which water is delivered to and from the casting roll 12 axially through stub shaft assembly 122. In operation, cooling water passes to and from the water flow passages 126 in the cylindrical tube 120 through radial passages 135 and 136 extending through end portions 127 and 128 of the stub shaft assemblies 121 and 122, respectively. The stub shaft assembly 121 is fitted with axial tube 137 to provide fluid communication between the radial passages 135 in end portions 127 and the central cavity within the casting roll 12. The stub shaft assembly 122 is fitted with an axial space tube, to separate a central water duct 138, in fluid communication with the central cavity 163, and from annular water flow duct 139 in fluid communication with radial passages 136 in end portion 128 of stub shaft assembly 122. Central water duct 138 and annular water duct 139 are capable of providing inflow and outflow of cooling water to and from the casting roll 12.

In operation, incoming cooling water may be supplied through supply line 131 to annular duct 139 through ports 133, which is in turn in fluid communication with the radial passages 136, gallery 150 and water flow passages 126, and then returned through the gallery 140, the radial passages 135, axial tube 137, central cavity 163, and central water duct 138 to outflow-line 132 through water flow ports 134. Alternatively, the water flow to, from and through the casting roll 12 may be in the reverse direction as desired. The water flow ports 133 and 134 may be connected to water supply and return lines so that water may flow to and from water How passages 126 in the cylindrical tube 120 of the casting roll 12 in either direction, as desired. Depending on the direction of flow, the cooling water flows through the cavity 163 either before or after flow through the water flow passages 126. It is appreciated that any other cooling variations may be employed as desired, such as single-pass cooling, by example.

Figure 8:
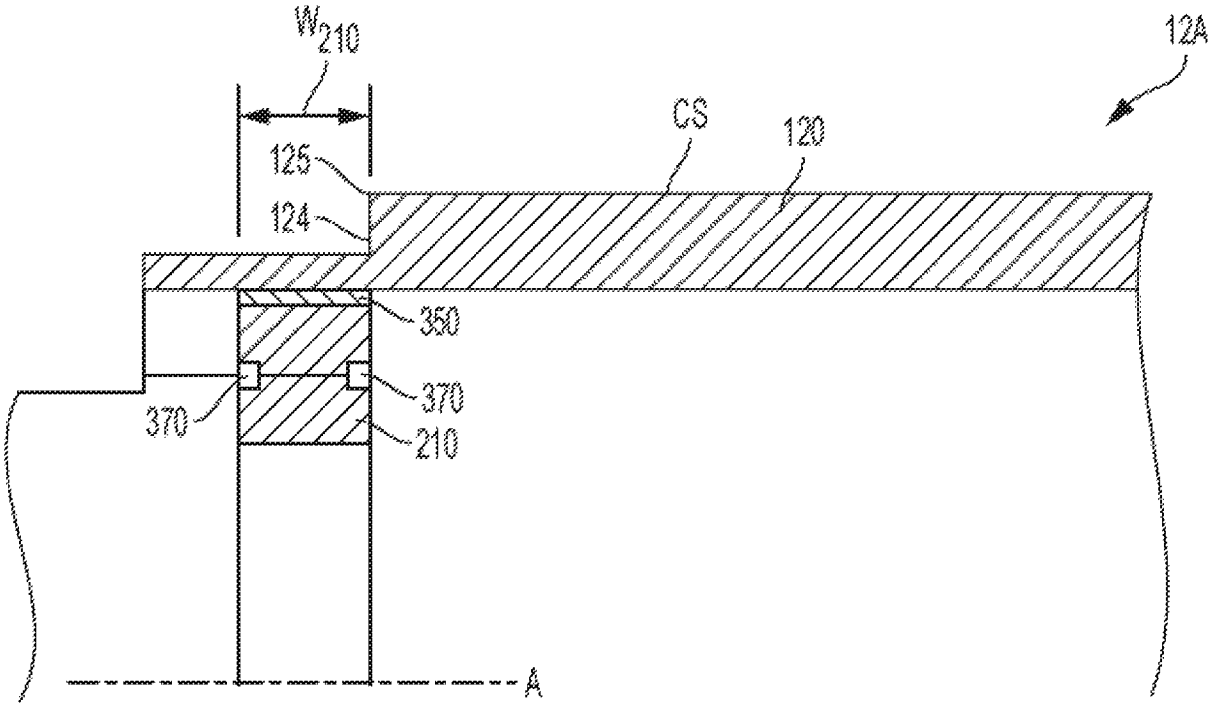
FIG. 8 is across sectional view longitudinally through a portion of a casting roll with an expansion ring spaced from the edge portions of the cast strip.
Figure 9:
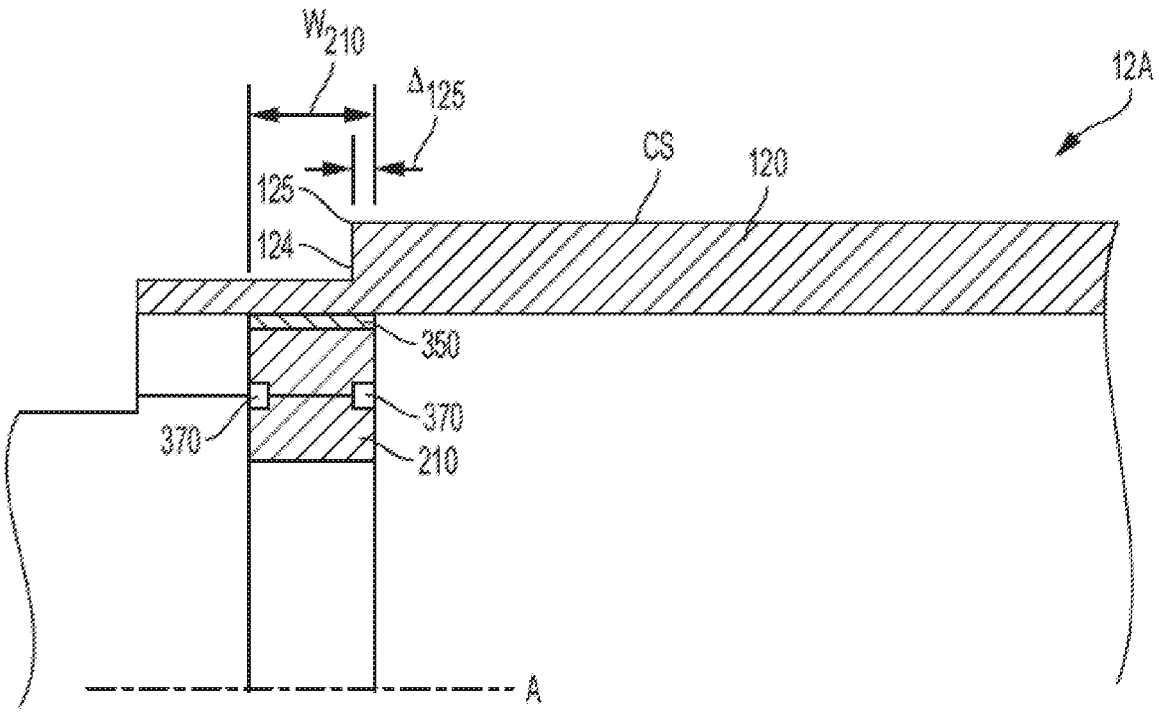
FIG. 9 is a cross sectional view longitudinally through a portion of a casting roll with an expansion ring spaced from the edge portions of the cast strip, the expansion ring being shifted relative to the expansion ring shown in the embodiment of FIG. 8.

As noted previously, each cylindrical tube may include two or more expansion rings. In an exemplary embodiment illustrated in FIG. 3A, each cylindrical tube 120 is provided with two expansion rings 210, each including an insulating coating 350 thereon. The two expansion rings are spaced apart and located on opposite end portions of the cylindrical tube 120 inward within 450 mm of edge portions of the cast strip formed during the casting campaign. These edge portions are also referred to herein as side edge portions of the strip, where the strip includes a pair of opposing side edges forming the strip width. FIG. 8 shows a cross sectional view longitudinally through a portion of a casting roll with expansion ring 210 with insulating coating 350 thereon spaced from the edge portions of the cast strip and having heating elements 370. In this embodiment, an expansion ring 210 is arranged in close proximity to both a side edge 125 of the casting surface CS and a side edge of a cast strip (when cast on the casting surface). Particularly, expansion ring 210 is arranged such that one side extent (an inner side) of the expansion ring width $W_{210}$ is aligned with the casting surface CS side edge 125 (as well as being substantially aligned with shoulder 124 formed by side edge 125), where the width Who extends outwardly away from the center of the casting roll 12A and cylindrical tube 120. In appreciating that expansion rings may be arranged at other locations within cylindrical tube 120, with reference to an exemplary embodiment in FIG. 9, the inner side of expansion ring 210 is now offset towards the center of the casting roll 12A or cylindrical tube 120 from casting surface side edge 125 by an offset distance of $\Delta_{125}$. By example, the expansion ring width is 67 mm and the offset distance $\Delta_{125}$ is 7 mm, although other distances may be employed as desired to achieve proper cast strip thicknesses.

Figure 10:
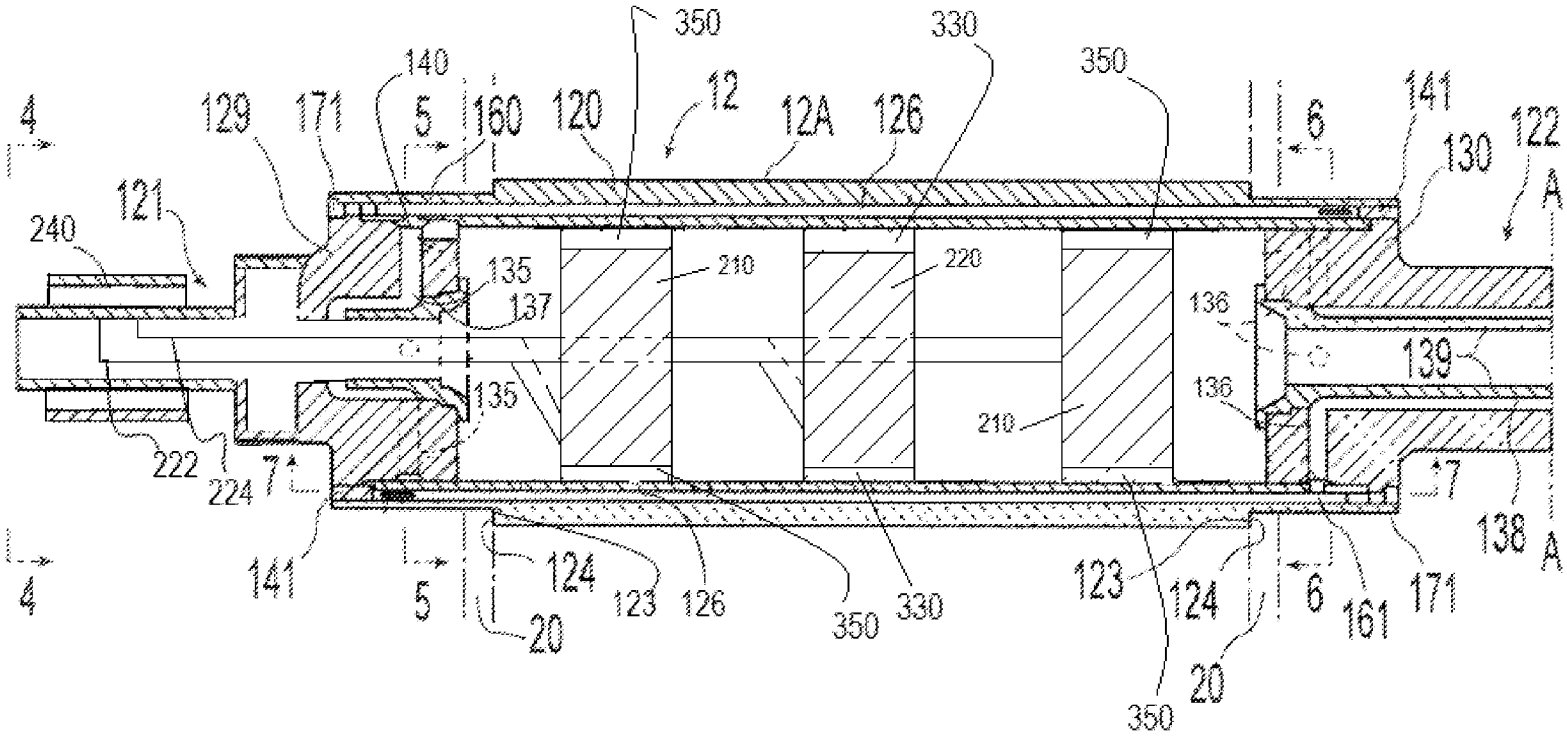
FIG. 10 is a cross sectional view longitudinally through a portion of one of the casting rolls of FIG. 2 with two expansion rings spaced from the edge portions of the cast strip and an expansion ring corresponding to center portions of the cast strip.

Alternatively, as illustrated in FIG. 10, at least two expansion rings 210 with insulating coating 350 thereon are spaced on opposite end portions of the cylindrical tube 120 within 450 mm of edge portions of the east strip on opposite end portions of the casting rolls during the casting campaign, and an additional expansion ring 220 with insulating coating 330 thereon is positioned within cylindrical tube 120 at a position corresponding to center portions of the cast strip formed on the casting surfaces during casting.

In any embodiment, each expansion ring may have an annular dimension between 50 and 150 mm; (e.g. 70 mm). Similarly, the expansion ring or rings with an insulating coating thereon positioned at corresponding to center portions of the cast strip formed during casting may have an annular dimension between 50 and 150 mm; (e.g. 70 mm). Each expansion ring may have a width of up to 200 mm (e.g., 83.5 mm).

Figure 11:
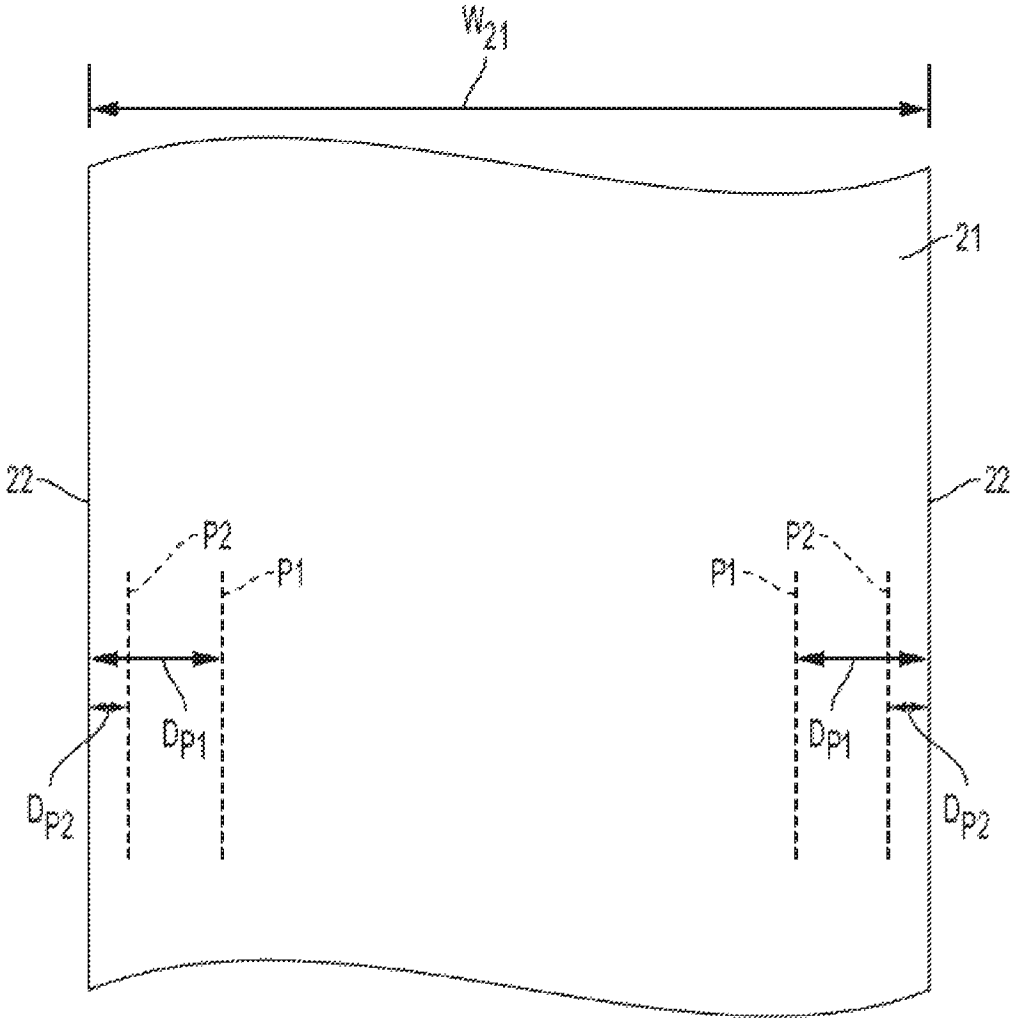
FIG. 11 is a top view of a cast strip showing locations for measuring the cast strip thickness according to particular embodiments of the invention.

Deformation of the crown of the casting surfaces of the casting rolls may be automatically controlled, thereby automatically controlling the thickness near the side edge of the cast strip. This is achieved by automatically regulating the radial dimension of the at least one expansion ring located inside the cylindrical tube. While the expansion ring may expand in any desired manner, in particular instances the radial dimension of any expansion ring may be controlled by automatically regulating the temperature of the expansion ring. In turn, the thickness profile near each side edge of the cast strip may be controlled by maintaining or altering the radius of the expansion ring and in turn the crown of the casting surfaces of the casting rolls. This thickness profile is also referred to as an "edge drop". A minimum edge drop is often targeted, so that the thickness of the strip nearest a widthwise side edge of the strip is not too thin. This thickness is also referred to as a "side edge thickness." In addition to generating a side edge thickness that is under a desired thickness, a side edge thickness that is too thin will generate waves along the side edge (where the side edge thickness undulates). Edge drop may be determined by measuring the thickness at two or more widthwise locations relative a side edge, where the measured values are compared to any representation of a target thickness profile to determine if any adjustment to the cylinder diameter is required to achieve the desired strip thicknesses. In particular embodiments, two measurements of the strip thickness are taken near a side edge, the first measurement location being located furthest from the corresponding side edge while the second measurement location is located closer to the corresponding side edge. It is appreciated that each first and second location may be located at any desired location. For example, with reference to FIG. 11 and cast strip 21, in certain embodiments the first location P1 is arranged a distance $D_{P1}$ of 75 to 125 mm from a corresponding side edge 22 and the second location P2 is arranged a distance $D_{P2}$ of 0 to 50 mm from the same side edge 22 in the direction of the cast strip width $W_{21}$. The edge drop is determined by subtracting the thickness measured at the second location P2 from the thickness measured at the first location P1, which can be expressed as: T1−T2=edge drop (where T1 is a thickness measured at the first location and T2 is a thickness measured at the second location). It is appreciated that the target edge drop may be zero (0) (where T1=T2) or may be positive (that is, where T1>T2). For example, where a positive edge drop is targeted, the positive edge drop is 50 to 100 microns (μm); however, other values are contemplated above or below this stated example.

Figure 12:
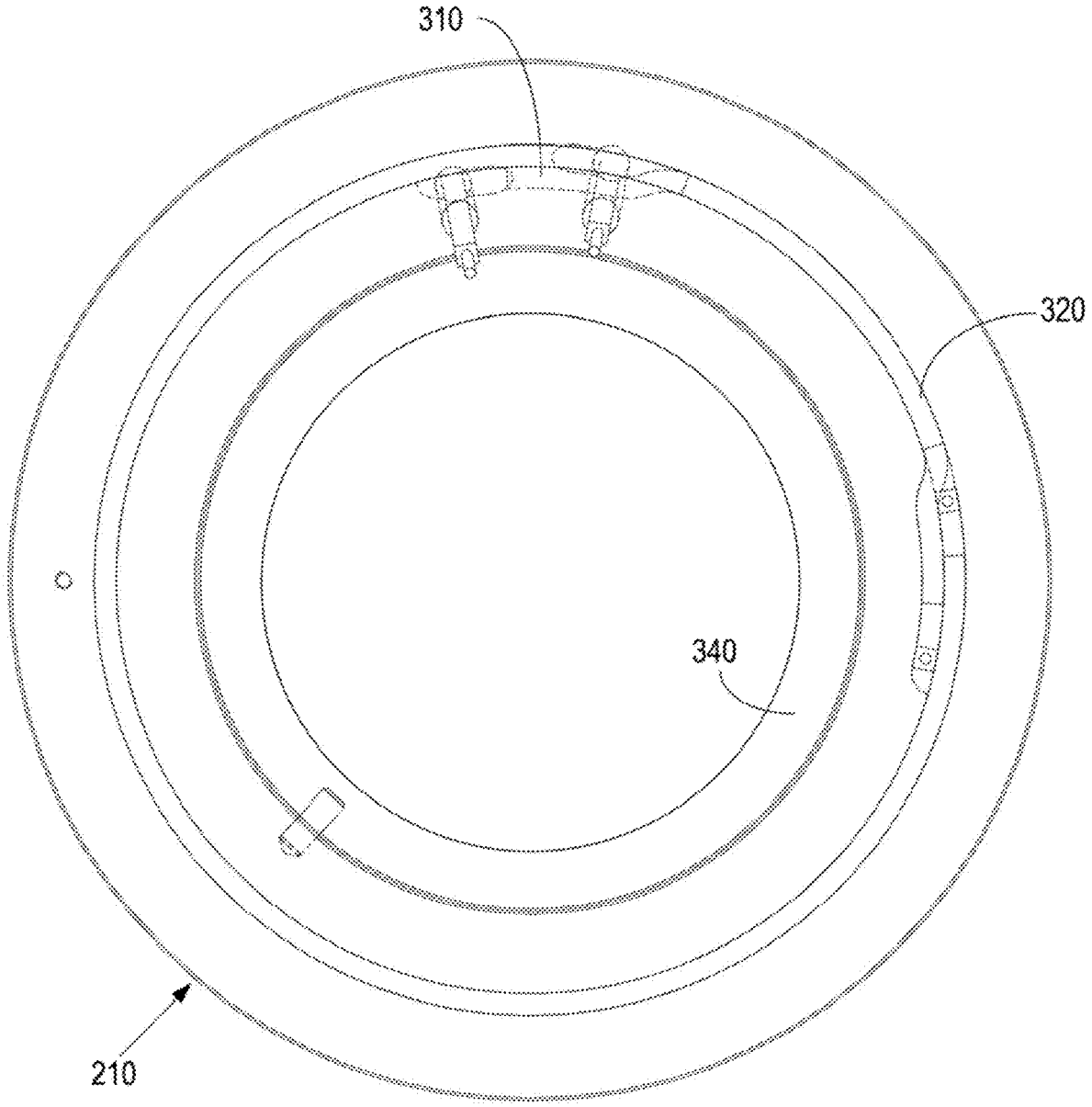
FIG. 12 is a cross sectional view of an expansion ring with water passages.

Because the circumferential thickness of the cylindrical tube is made sufficiently thin, such as to a thickness of no more than 80 mm, for example, the crown of the casting surfaces may be deformed responsive to changes in the radial dimension of the expansion rings. To achieve this deformation, each expansion ring is adapted to change in radial dimension causing the cylindrical tube to expand or contract, and thereby change the crown of the casting surfaces and the thickness profile of the cast strip during casting. In the exemplary embodiment shown in FIG. 10, this is achieved by controlling the temperature of the expansion ring, where a power wire 222 and control wire 224 each extend from slip ring 240 to each expansion ring. Power wire 222 supplies electrical power to the expansion ring. Control wire 224 provides the temperature feedback that is then used to control the power of the expansion ring. As shown in FIG. 12, each expansion ring 210 may have water passages 340 therein wherein water can flow through. The water flow may be controlled by logic controller 72 to regulate the expansion of the expansion rings.

Figure 13:
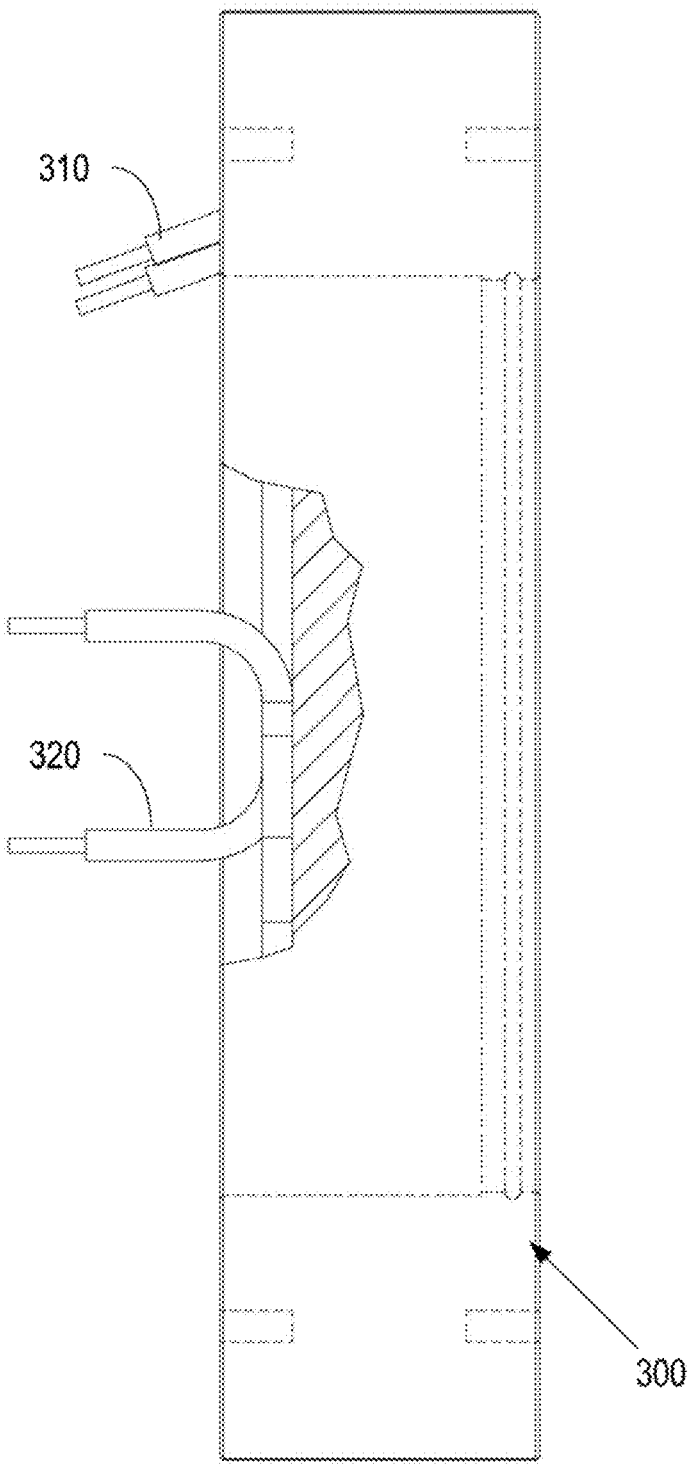
FIG. 13 is a side and cross sectional view of an expansion ring with heating elements.

As previously noted, each expansion ring may be electrically heated to increase its radial dimension. Referring to die exemplary embodiment illustrated in FIG. 13, each expansion ring has at least one heating element positioned as desired to effectively heat the ring. Expansion ring 300 has heating element 310 on the right side and heating element 320 on the left side for that purpose. Each expansion ring may provide a heating input of up to 30 kW; preferably, of at least 3 kW. The force generated from the increase in radial dimension will be applied on the cylindrical tube causing the cylindrical tube to expand changing the crown of the casting surfaces and the thickness profile of the cast strip.

To achieve a desired thickness profile by control of the radial dimension of the expansion rings and control of the casting speed, a strip thickness profile sensor 71 may be positioned downstream to detect the thickness profile of the cast strip 21 as show n in FIGS. 2 and 2A. The strip thickness sensor 71 is provided typically between the nip 18 and the pinch rolls 31A to provide for direct control of the casting roll 12. The sensor may be an x-ray gauge or other suitable device capable of directly measuring the thickness profile across the width of the strip periodically or continuously. It is appreciated that in lieu of having one profile sensor, multiple sensors may be employed to measure the strip thickness at different corresponding locations across the strip width. For example, in particular instances, a plurality of non-contact type sensors are arranged across the cast strip 21 at the guide table 30 and the combination of thickness measurements from the plurality of positions across the cast strip 21 are processed by a logic controller 72 to determine the thickness profile of the strip periodically or continuously. The thickness profile of the cast strip 21 may be determined front this data periodically or continuously as desired. Logic controller 72 may be a dedicated logic controller or a general purpose computer with appropriate programming.

The radial dimension of each expansion ring may be controlled independently from the radial dimension of the other expansion ring or rings. The radial dimension of the each expansion ring with an insulating coating thereon within and adjacent the strip edges of the casting rolls may be controlled independently from each other. Additionally, the radial dimension of the expansion rings within and adjacent the strip edges of the casting rolls may be controlled independently from the expansion ring or rings with insulating coating thereon corresponding to the center portions of the cast strip. The sensor 71 generates signals indicative of the thickness profile of the cast strip. The radial dimension of each expansion ring with an insulating coating thereon is controlled according to the signals generated by the sensor, which in turns control roll crown of the casting surfaces of the casting rolls during the casting campaign.

Furthermore, the casting roll drive may be controlled to vary the speed of rotation of the casting rolls, while also varying the radial dimension of the expansion ring responsive to the electrical signals received from the sensor 71 controlling in turn the roll crown of the casting surfaces of the casting rolls during the casting campaign.

The use of an insulating coating is helpful to control beat transfer from the expansion ring to the casting roll. In particular, heat transferred from the expansion rings to the casting rolls during casting is minimal with the insulating coating arranged thereon. Additionally, expansion rings including the insulating coating may be heated more rapidly than those without any such coating, which also allows an expansion ring to achieve a high effective temperature. In certain instances, an insulating coating of at least 0.010 inch in thickness (e.g. 0.025 mm) is desired to control or eliminate heat transfer from the expansion ring to the casting roll. While any insulating material suitable for its intended purpose for use on the expansion rings may be employed, in certain instances, the insulating coating comprises 8% Yttria stabilized zirconia, which may or may not be plasma sprayed onto the outside of an expansion ring. It is appreciated that five insulating coating may have a minimum thickness of at least 0.010 inch oral least 0.025 mm.

In each of these embodiments of the method and apparatus, the expansion rings may also have water passages there through to permit the flow of w ater through the passages in the rings, and regulate the water flow through those passages. The water flow is regulated by logic controller 72 to increase or decrease the diameter of the expansion rings and in turn cylindrical tube as desired, and control the shape of the casting rolls during a campaign.

Figure 14:
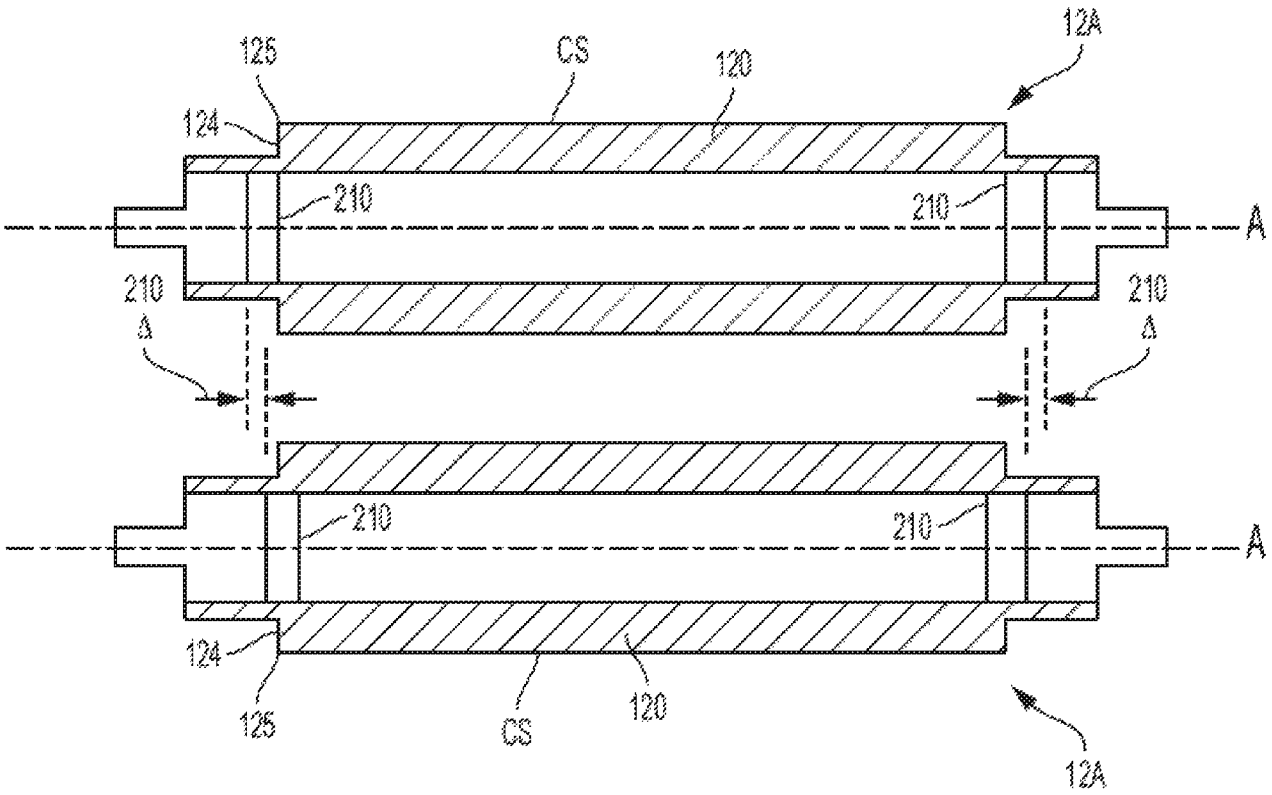
FIG. 14 is a top view of a pair of casting rolls showing in each a pair of expansion rings where each ring is arranged in close proximity to both a side edge of the casting surface and a side edge of the cast strip, w here the expansion rings of one casting roll are offset relative to a corresponding expansion ring in the other casting roll.

With reference to an exemplary embodiment in FIG. 14, two expansion rings 210 are arranged in each cylindrical tube for each of the pair of casting rolls arranged in close proximity to a side edge 125 of each casting roll casting surface CS, although additional expansion rings could be employed at other locations in other variations. As noted previously, while each expansion ring in one casting roll may be arranged at a substantially identical axial location relative to a corresponding expansion ring in the other casting roll of a pair of casting rolls with regard to expansion rings arranged in close proximity to side edges of a cast strip or of a casting surface, in the instance shown, the pair of casting rings in one casting roll are arranged at a different axial location relative to a corresponding expansion ring in the other casting roll to offer more flexibility in controlling the cast strip thickness. This difference between corresponding expansion rings 210 in different casting rolls 12 is designated offset distance 210*a*. In this specific instance, two expansion rings arranged in one casting roll 12 (or cylindrical tube 120) closer to a center (or centerline) of the roll or tube than the two expansion rings arranged in the oilier roll or tube. While the expansion rings 210 in each casting toll 12 are symmetrically arranged within each corresponding casting roll 12, in other variations, asymmetrical arrangements may be employed within each casting roll, which may or may not provide a difference between offsets (210*a*) between corresponding side edges (125).

Figure 15:
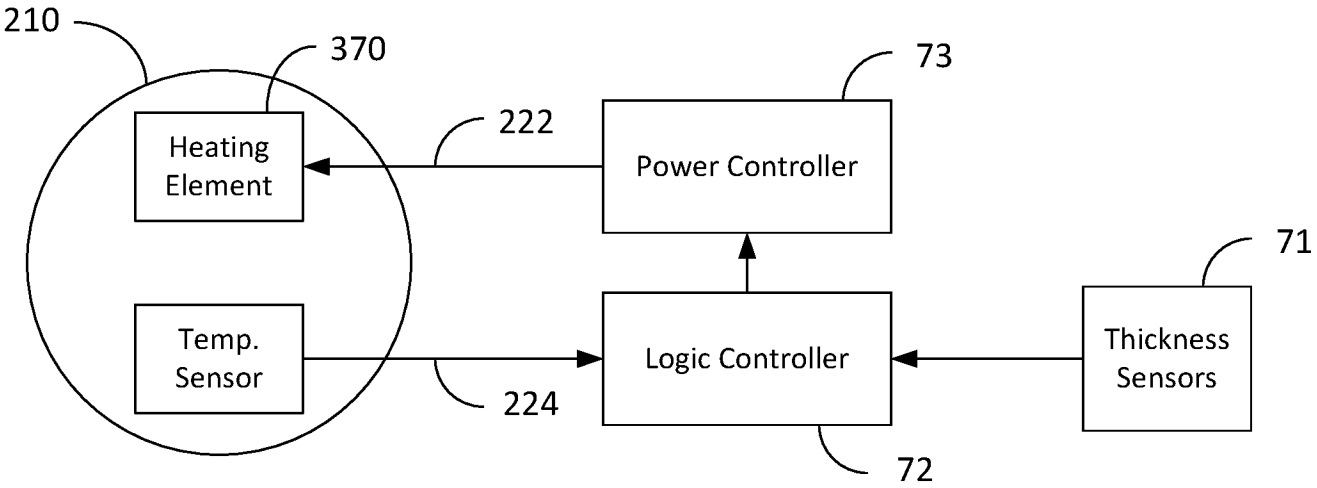
FIG. 15 is a block diagram of a control system and casting roll.
Figure 16:
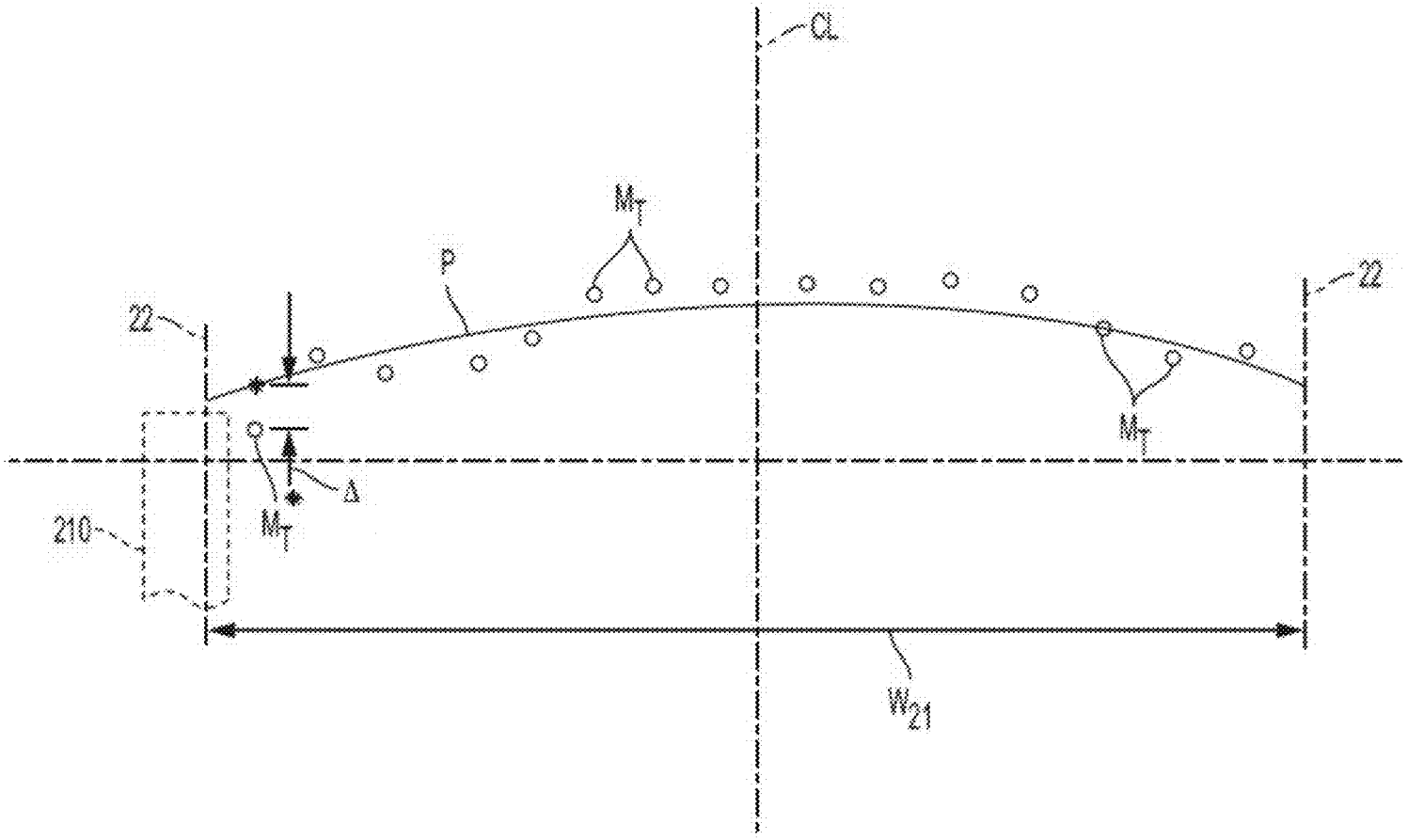
FIG. 16 is a plot showing a plurality of thickness measurements taken along the width of a cast strip, where a polynomial curve has been fit to the plurality of thickness measurements in accordance with particular embodiments of the invention.
Figure 17:
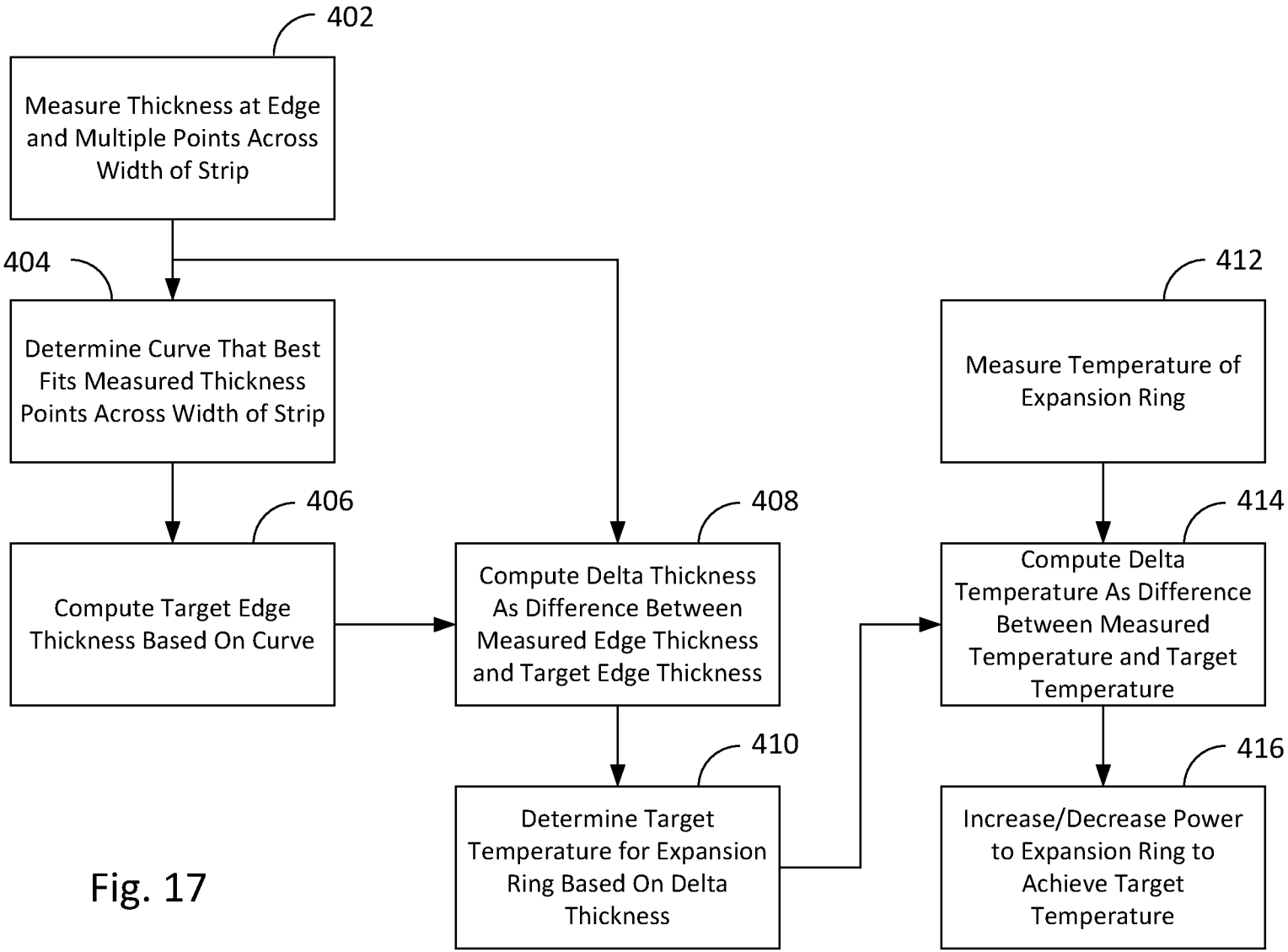
FIG. 17 is a flow chart of a control process.

Edge thickness control relative to cast strip thickness may be achieved according to one aspect of the present invention. With reference to FIGS. 15-17, thickness measurements $M_T$ are taken substantially along a line extending directly across the cast strip width $W_{21}$ in a direction perpendicular to the casting direction (that is, measurements are made in a line perpendicular to a lengthwise direction of the strip) in step 402 and provided to the logic controller 72. In the embodiment shown, the thickness measurements $M_T$ extend across the substantial width $W_{21}$ of the strip. In accordance with certain embodiments of the methods described herein, a plurality of thickness measurements $M_T$ may be represented as a plot of thickness versus width in association with each widthwise location at which the measurement was taken across the strip width $W_{21}$, as in FIG. 16. As noted elsewhere herein, one or more thickness measurements may only be taken in close proximity to the strip edge or along a greater portion than at the strip edge, such as along a half of the width $W_{21}$, that is, up to a widthwise centerline CL of the strip width $W_{21}$ or for the substantial full width $W_{21}$ as exemplarily shown. It is appreciated that the measurements may be taken at constant or random intervals (spacings). For any series of thickness measurements taken across the cast strip width, the logic controller 72 performs a polynomial curve fit in step 404, such as by way of regression, to arrive at a polynomial curve P that best fits the plurality of measurements $M_T$. The measurements may be updated periodically or continuously and logic controller 72 configured to fit a new curve to updated measurements. In the embodiment shown, the polynomial curve is a parabola and describes a cast strip having a convex thickness, where the center thickness is greatest and whereby the thickness gradually decreases towards the side edges 22. For a constant thickness strip, the measured thicknesses and curve fit would be linear.

Once a curve has been fit to the measured thicknesses and their locations along the strip width, a target edge thickness is computed based on the curve in step 406. The target edge thickness may comprise an extrapolation of the polynomial curve, or an extrapolation of the polynomial curve with a positive or negative offset added. The measured thickness of each edge is compared to the target edge thickness for each edge (which may be the same), anti a delta thickness is determined as a difference between the measured edge thickness and the target edge thickness in step 408. The measurements may be updated periodically or continuously, and delta thickness recalculated accordingly. In this way, edge thickness may be dynamically controlled relative to an overall profile of strip of metal as it is being cast, rather than having a static target thickness.

The above process may also be performed for each of one or more measured thicknesses capable of being altered by way of an expansion ring. These widthwise locations that may be affected by an expansion ring are at least located at or in close proximity to any widthwise location of an expansion ring, where such location may be any location of an expansion ring contemplated herein, including without limitation the widthwise location of any expansion ring shown in FIGS. 3A, 8, 9. It may be that a measured thickness arranged between a pair of expansion rings may be affected by expansion or contraction of the pair of expansion rings, so it is the effect of one or more (multiple) expansion rings that should be considered. Should the measured thickness deviate from the curve fit thickness at the same widthwise location, a corresponding expansion ring is expanded or contracted as needed to alter the measured thickness to correspond to the curve fit thickness. With reference to FIG. 16, measured thickness $M_T$* is located along the strip width $W_{21}$ at a location that was at or near a corresponding expansion ring 210 (shown in dashed imaginary lines) during its formation, and upon comparison with the fit curve P, a deviation A (variation) is determined. Thereafter, the outer diameter of the corresponding expansion ring is changed to reduce or eliminate the deviation A for subsequent strip formation. A corresponding expansion ring is one that is located at or sufficiently near or in close proximity to the measured location along the width of the strip as it corresponds to its location along the casting roll. This "correction" of a measured thickness may be performed in relation to a measured thickness closely associated with any expansion ring—whether or not such expansion ring is located at or near a side edge of the strip or more centrally across the width of the strip. Of course, other variations may be performed in accordance with this disclosure.

The diameters of the expansion rings are controlled by controlling a temperature of each expansion ring. Temperature control may be achieved with electric heating and water cooling. For example, for edge thickness control, the delta thickness may be used to determine a target temperature for the corresponding expansion ring in step 410. For example, the delta thickness may be integrated overtime to generate a target temperature. The temperature sensors of the expansion ring measure the temperature of the expansion ring in step 412 and provide signals indicative of that temperature to the logic controller 72. The logic controller 72 determines a delta temperature between the target temperature and the measured temperature in step 414, and causes power to the heating element 370 of the expansion ring to be increased or decreased to reduce the delta temperature in step 416. For example, logic controller 72 may be coupled to a power controller 73, which regulates power to the heating element 370. The power controller 73 may comprise one or more silicon controlled rectifiers (SCR). As the expansion ring expands (narrowing thickness) or contracts (increasing thickness), the logic controller 72 updates the delta thickness computations and target temperature computations. This process may be performed continuously or periodically on an iterative basis.

While principles and modes of operation have been explained and illustrated with regard to particular embodiments, it must be understood, however, that the invention may be practiced otherwise than as specifically explained and illustrated without departing from its spirit or scope.

The invention claimed is:

1. A casting roll control system with adjustable circumference control for use in a twin roll caster for producing cast strip metal, comprising:

a casting roll including a casting surface formed by a cylindrical tube;

a logic controller;

a first expansion ring disposed within the cylindrical tube within 450 mm of an edge of the casting surface, the first expansion ring having at least one heating element and at least one temperature sensor adapted to provide signals indicative of expansion ring temperature, the at least one temperature sensor being coupled to the logic controller, the first expansion ring being formed of a material that expands an outer diameter of the first expansion ring when heated by the at least one heating element, thereby expanding an outer diameter of the casting surface corresponding to a location of the first expansion ring; and a plurality of strip thickness sensors adapted to provide output signals indicative of a thickness of a cast strip capable of being arranged to make thickness measurements across a width of a cast strip in a line substantially perpendicular to a casting direction including an edge thickness and being coupled to the logic controller;

wherein the logic controller is configured with instructions stored in non-volatile memory to receive thickness measurements from the strip thickness sensors and temperature measurements from the at least one temperature sensor, fit a curve to the thickness measurements, determine a target edge thickness of the cast strip based on the curve, determine a delta thickness as a difference between the measured edge thickness and the target edge thickness and cause an amount of power applied to the at least one heating element to be adjusted to reduce the delta thickness.

2. The casting roll control system of claim 1, wherein the curve fitted to the thickness measurements is a polynomial function defining a parabola.

3. The casting roll control system of claim 1, wherein the target edge thickness is determined as an extrapolation of the curve fitted to the thickness measurements.

4. The casting roll control system of claim 1, wherein the target edge thickness is determined as an extrapolation of the curve fitted to the thickness measurements with a positive or negative offset added.

5. The casting roll control system of claim 1, further comprising a power controller coupled between the logic controller and the at least one heating element, wherein the power controller increases and decreases an amount of power being applied to the at least one heating element in response to a signal from the logic controller.

6. The casting roll control system of claim 1, wherein the logic controller is configured to periodically update the curve fitted to the thickness measurements based on new measurements, and periodically update the target edge thickness based on the updated curve.

7. The casting roll control system of claim 1, wherein the logic controller is configured to continuously update the curve fitted to the thickness measurements based on new measurements, and continuously update the target edge thickness based on the updated curve.

8. The casting roll control system of claim 1, wherein the logic controller is configured with instructions stored in non-volatile memory to cause an amount of power applied to the at least one heating element to be adjusted by determining a target temperature of the first expansion ring based on the delta thickness, measuring the temperature of the first expansion ring, determining a delta temperature as a difference between the measured temperature with the target temperature, and causing an amount of power applied to the at least one heating element to be adjusted to reduce the delta temperature.

9. The casting roll control system of claim 1, further comprising a second expansion ring disposed within 450 mm of an edge of the casting surface opposite the first expansion ring and controlled in a likewise manner.

10. The casting roll control system of claim 1, wherein the first expansion ring is disposed inwardly from the edge of the casting surface.

11. A casting roll control system with adjustable circumference control for use in a twin roll caster for producing cast strip metal, comprising:

a casting roll including a casting surface formed by a cylindrical tube;

a logic controller;

a first expansion ring disposed within the cylindrical tube and under a step which forms a shoulder of the casting surface, the first expansion ring having at least one heating element and at least one temperature sensor adapted to provide signals indicative of expansion ring temperature, the at least one temperature sensor being coupled to the logic controller, the first expansion ring being formed of a material that expands an outer diameter of the first expansion ring when heated by the at least one heating element, thereby expanding an outer diameter of the casting surface corresponding to a location of the first expansion ring; and a plurality of strip thickness sensors adapted to provide output signals indicative of a thickness of a cast strip capable of being arranged to make thickness measurements across a width of a cast strip in a line substantially perpendicular to a casting direction including an edge thickness and being coupled to the logic controller;

wherein the logic controller is configured with instructions stored in non-volatile memory to receive thickness measurements from the strip thickness sensors and temperature measurements from the at least one temperature sensor, fit a curve to the thickness measurements, determine a target edge thickness of the cast strip based on the curve, determine a delta thickness as a difference between the measured edge thickness and the target edge thickness and cause an amount of power applied to the at least one heating element to be adjusted to reduce the delta thickness.

12. The casting roll control system of claim 11, wherein the curve fitted to the thickness measurements is a polynomial function defining a parabola.

13. The casting roll control system of claim 11, wherein the target edge thickness is determined as an extrapolation of the curve fitted to the thickness measurements.

14. The casting roll control system of claim 11, wherein the target edge thickness is determined as an extrapolation of the curve fitted to the thickness measurements with a positive or negative offset added.

15. The casting roll control system of claim 11, further comprising a power controller coupled between the logic controller and the at least one heating element, wherein the power controller increases and decreases an amount of power being applied to the at least one heating element in response to a signal from the logic controller.

16. The casting roll control system of claim 11, wherein the logic controller is configured to periodically update the curve fitted to the thickness measurements based on new measurements, and periodically update the target edge thickness based on the updated curve.

17. The casting roll control system of claim 11, wherein the logic controller is configured to continuously update the curve fitted to the thickness measurements based on new measurements, and continuously update the target edge thickness based on the updated curve.

18. The casting roll control system of claim 11, wherein the logic controller is configured with instructions stored in non-volatile memory to cause an amount of power applied to the at least one heating element to be adjusted by determining a target temperature of the first expansion ring based on the delta thickness, measuring the temperature of the first expansion ring, determining a delta temperature as a difference between the measured temperature with the target temperature, and causing an amount of power applied to the at least one heating element to be adjusted to reduce the delta temperature.

19. The casting roll control system of claim 11, further comprising a second expansion ring disposed under a step opposite the first expansion ring and controlled in a likewise manner.

20. The casting roll control system of claim 11, wherein the first expansion ring is aligned with an edge of the casting surface.

* * * * *